US012110662B2

(12) United States Patent
Kurokami et al.

(10) Patent No.: US 12,110,662 B2
(45) Date of Patent: Oct. 8, 2024

(54) WORK MACHINE

(71) Applicant: Hitachi Construction Machinery Co., Ltd., Tokyo (JP)

(72) Inventors: Kazushige Kurokami, Kashiwa (JP); Takaaki Ishii, Ushiku (JP); Shigeki Tokita, Tsuchiura (JP); Hiroshi Sakamoto, Kashiwa (JP); Yoshiyuki Tsuchie, Matsudo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 221 days.

(21) Appl. No.: 17/909,506

(22) PCT Filed: May 26, 2021

(86) PCT No.: PCT/JP2021/020060
§ 371 (c)(1),
(2) Date: Sep. 6, 2022

(87) PCT Pub. No.: WO2021/241652
PCT Pub. Date: Dec. 2, 2021

(65) Prior Publication Data

US 2023/0114481 A1 Apr. 13, 2023

(30) Foreign Application Priority Data

May 29, 2020 (JP) ..... 2020-094869

(51) Int. Cl.
*E02F 3/32* (2006.01)
*E02F 9/20* (2006.01)
(Continued)

(52) U.S. Cl.
CPC ..... *E02F 9/24* (2013.01); *E02F 9/2033* (2013.01); *E02F 9/262* (2013.01); *E02F 3/32* (2013.01);
(Continued)

(58) Field of Classification Search
CPC . E02F 9/24; E02F 9/2033; E02F 9/262; E02F 3/32; E02F 9/2228; E02F 9/2285; E02F 9/2292; E02F 9/2296
See application file for complete search history.

(56) References Cited

U.S. PATENT DOCUMENTS

2013/0088593 A1 4/2013 Ishimoto
2018/0201132 A1 7/2018 Cherney
2020/0226849 A1 7/2020 Mizuochi et al.

FOREIGN PATENT DOCUMENTS

JP 4-15663 U 2/1992
JP 2002-327469 A 11/2002
(Continued)

OTHER PUBLICATIONS

International Preliminary Report on Patentability (PCT/IB/338 & PCT/IB/373) issued in PCT Application No. PCT/JP2021/020060 dated Dec. 8, 2022, including English translation of document C2 (Japanese-language Written Opinion (PCT/ISA/237), filed on Sep. 6, 2022) (five (5) pages).
(Continued)

*Primary Examiner* — Mathew Franklin Gordon
(74) *Attorney, Agent, or Firm* — Crowell & Moring LLP

(57) ABSTRACT

A work machine includes: an informing device that informs an operator; an input device for inputting predetermined information; a notification device that gives a notification to a worker around the work machine; a controller; and a communication device that communicates with a mobile terminal carried by the worker. The controller determines whether or not an approval request for requesting approval of entry into a movable range of the work machine transmitted from the mobile terminal when the worker around the work machine operates the mobile terminal has been received; inform, by using the informing device, that the approval request has been received when it is determined
(Continued)

that the approval request has been received; determine whether or not approval operation of approving entry into the movable range has been performed on the input device; set an interpersonal communication level representing a degree of interpersonal communication between the operator and the worker depending on whether or not the approval request has been received and whether or not the approval operation has been performed; decide a mode of notification in accordance with the interpersonal communication level; and give a notification in the mode of notification by using the notification device.

6 Claims, 18 Drawing Sheets

(51) Int. Cl.

| | |
|---|---|
| ***E02F 9/24*** | (2006.01) |
| ***E02F 9/26*** | (2006.01) |
| *E02F 9/22* | (2006.01) |

(52) U.S. Cl.
CPC ..... *E02F 9/2228* (2013.01); *E02F 9/2285* (2013.01); *E02F 9/2292* (2013.01); *E02F 9/2296* (2013.01)

(56) References Cited

FOREIGN PATENT DOCUMENTS

| | | | |
|---|---|---|---|
| JP | 2009-193494 | A | 8/2009 |
| JP | 2019-60108 | A | 4/2019 |
| JP | 2019-169778 | A | 10/2019 |
| JP | 2020-12323 | A | 1/2020 |

OTHER PUBLICATIONS

International Search Report (PCT/ISA/210) issued in PCT Application No. PCT/JP2021/020060 dated Jul. 27, 2021 with English translation (five (5) pages).
Japanese-language Written Opinion (PCT/ISA/237) issued in PCT Application No. PCT/JP2021/020060 dated Jul. 27, 2021 (three (3) pages).
Extended European Search Report issued in European Application No. 21812241.4 dated Jun. 13, 2024, (8 pages).

FIG. 7A

| ID | POSITION |
|---|---|
| A | INSIDE MOVABLE RANGE |
| B | OUTSIDE MOVABLE RANGE |
| C | INSIDE WORK RANGE |

FIG. 7B

| ID | APPROVAL REQUEST |
|---|---|
| A | NOT RECEIVED |
| B | RECEIVED |
| C | RECEIVED |

FIG. 7C

| ID | INTERPERSONAL COMMUNICATION LEVEL |
|---|---|
| A | 1 |
| B | 2 |
| C | 3 |

| MODE OF NOTIFICATION | LIGHT: RED/FLASHING<br>BUZZER: NO |
|---|---|

WORK MACHINE

TECHNICAL FIELD

The present invention relates to a work machine.

BACKGROUND ART

In recent years, as the working population at construction work sites decreases, higher efficiency at work sites has been called for. One of objects for higher efficiency at work sites is realization of smooth collaborative work between work machines and workers performing work around the work machines. At typical work sites, around work machines such as hydraulic excavators, there are often workers who are performing work such as assisting operation of the work machines, carrying materials, or giving construction instructions.

Workers are normally positioned outside movable ranges of work machines. Where a worker is to enter a movable range, she/he needs to check in advance that a work machine which is stopped does not start moving or an operator of the work machine has noticed the presence of the worker, in order to prevent contact with the work machine. However, it is difficult to judge at a glance from around the work machine whether or not there is a possibility that the work machine starts moving. In addition, it is not easy to communicate with the operator of the work machine who is in a noisy environment, and is concentrated on her/his work. Because of this, it takes time undesirably to judge whether or not the worker is allowed to enter the movable range, and there is a fear that this lowers the work efficiency.

Patent Document 1 discloses a work machine including a signaling display that signals the start of an engine; and a signaling light that signals a swing at a time of the swing. With the work machine described in Patent Document 1, at a time of an engine start, the signaling display provided to the work implement flashes automatically, and also a sound for informing that the engine is started is output from a speaker.

PRIOR ART DOCUMENT

Patent Document

Patent Document 1: JP-2002-327469-A

SUMMARY OF THE INVENTION

Problem to be Solved by the Invention

The technology described in Patent Document 1 is for one-sidedly informing workers around the work machine of operation such as an engine start or a swing of the work machine by using the signaling display, the speaker, or the like. Accordingly, the workers cannot make a judgment about the operation intended by the operator. In addition, the workers also cannot judge whether the operator of the work machine has noticed their presence. Because of this, for example, where the operator of the work machine starts the engine after a worker has checked that the engine of the work machine is stopped and has entered a movable range of the work machine, the worker needs to evacuate to the outside of the movable range of the work machine even if the operator does not intend to perform work for a while thereafter. In addition, after the evacuation, the worker needs to communicate with the operator of the work machine such that her/his presence is noticed. There is a fear that, as a result, the work efficiency at the work site lowers.

An object of the present invention is to provide a work machine that can make it possible to appropriately allow interpersonal communication between a worker and an operator of the work machine when the worker enters a movable range of the work machine, and to attempt to enhance the work efficiency.

Means for Solving the Problem

A work machine according to an aspect of the present invention includes a machine body; a work implement attached to the machine body; an operation device that is provided in an operation room, and gives an instruction about operation of the work implement according to operation by an operator; an informing device that informs the operator; an input device for inputting predetermined information; a notification device that gives a notification to a worker around the work machine; a controller that controls the informing device and the notification device; and a communication device that communicates with a mobile terminal carried by the worker. The controller is configured to: determine whether or not the communication device has received an approval request for requesting approval of entry into a movable range of the work machine, the approval request being transmitted from the mobile terminal when the worker operates the mobile terminal; inform, by using the informing device, that the approval request has been received, when it is determined that the approval request has been received; determine whether or not approval operation of approving entry into the movable range of the work machine has been performed on the input device; set an interpersonal communication level representing a degree of interpersonal communication between the operator and the worker, depending on whether or not the approval request has been received and whether or not the approval operation has been performed; decide a mode of notification by the notification device in accordance with the interpersonal communication level; and give a notification in the decided mode of notification by using the notification device.

Advantages of the Invention

According to the present invention, a work machine that can make it possible to appropriately allow interpersonal communication between a worker and an operator of the work machine when the worker enters a movable range of the work machine, and to attempt to enhance the work efficiency can be provided.

BRIEF DESCRIPTION OF THE DRAWINGS

FIG. 7A is a figure depicting a worker position table.

FIG. 7B is a figure depicting an approval request monitoring table.

FIG. 7C is a figure depicting an interpersonal communication level table.

MODE FOR CARRYING OUT THE INVENTION

A work machine according to an embodiment of the present invention is explained with reference to the figures. The work machine is a crawler-type hydraulic excavator in examples explained in the present embodiment.

Figure 1:
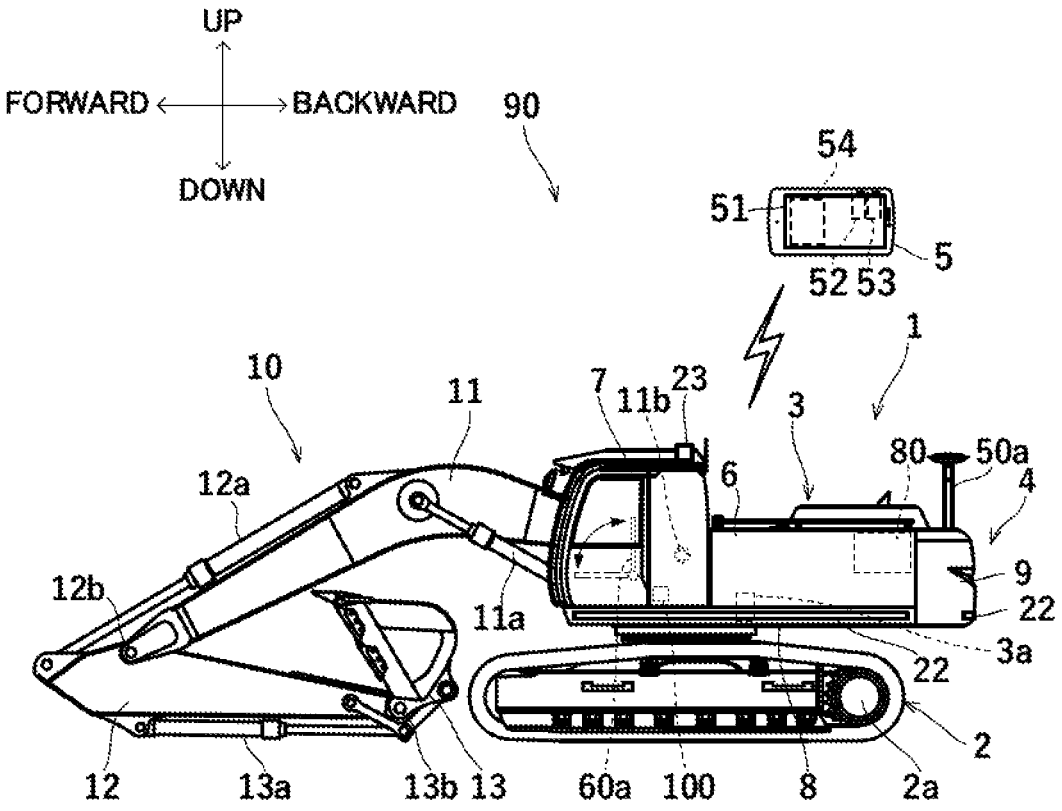
FIG. 1 is a figure depicting a surrounding environment monitoring system of a hydraulic excavator.

FIG. 1 is a figure depicting a surrounding environment monitoring system 90 of a hydraulic excavator 1. For convenience of explanation, the forward, backward, upward, and downward directions of the hydraulic excavator 1 are defined as depicted in FIG. 1. That is, in the present embodiment, unless noted otherwise particularly, the forward direction (the leftward direction in the figure) from an operator's seat is defined as the forward direction of the hydraulic excavator 1.

The surrounding environment monitoring system 90 includes the hydraulic excavator 1, and a mobile terminal 5 carried by a worker performing work around the hydraulic excavator 1. Note that whereas only one mobile terminal 5 is depicted in FIG. 1 for simplification of the figure, a plurality of workers perform work around the hydraulic excavator 1 in some cases.

As an example, the mobile terminal 5 is a tablet PC in an example explained in the present embodiment. Note that the mobile terminal 5 is not limited to a tablet PC, but may be a smartphone, a note PC, or the like. The mobile terminal 5 includes a wireless communication device 52 for performing wireless communication with the hydraulic excavator 1.

The mobile terminal 5 includes a touch panel 51, the wireless communication device 52 for performing wireless communication with the hydraulic excavator 1, a GNSS module 53 for computing the position of the mobile terminal 5, and a terminal controller 54. The terminal controller 54 functions as a terminal controller that controls sections such as the touch panel 51, the wireless communication device 52, and the GNSS module 53. The terminal controller 54 is configured by using a microcomputer including: a CPU (Central Processing Unit) as an operation circuit; a volatile memory which is a so-called RAM (Random Access Memory) as a storage device; a non-volatile memory such as an EEPROM or a flash memory as a storage device; an input/output interface (I/O interface) which is not depicted; and other peripheral circuits.

The touch panel 51 is provided on the front surface (front side) of the mobile terminal 5. The touch panel 51 has an input section, and a display section on which various types of information are displayed. For example, the display section is a liquid crystal display, and displays, on its display screen, display images representing various types of information on the basis of signals from the terminal controller 54 to thereby inform the worker of various types of information. For example, the input section is a touch sensor on which input operation by fingers, a touch pen, and the like is possible, and inputs, to the terminal controller 54, predetermined information according to operation by an operator.

The GNSS module 53 is a device that senses the position of the mobile terminal 5 by using a GNSS (Global Navigation Satellite System: global navigation satellite system). That is, the mobile terminal 5 has a functionality of acquiring positional information about itself. The terminal controller 54 acquires satellite signals (GNSS radio waves) from a plurality of positioning satellites, and computes the position of itself in a geographic coordinate system (global coordinate system).

The terminal controller 54 transmits, to the hydraulic excavator 1, a terminal ID, information about the position of itself, and the like by using the wireless communication device 52.

The hydraulic excavator 1 includes a machine body (machine body) 4, and a work implement 10 attached to the machine body 4. The machine body 4 includes a travel structure 2, and a swing structure 3 swingably provided on the travel structure 2. The work implement 10 is attached to a front portion of the swing structure 3. The travel structure 2 travels when a pair of left and right crawlers are driven by travel motors 2*a*. The swing structure 3 is driven by a swing motor 3*a*, and pivots relative to the travel structure 2.

The swing structure 3 has: a swing frame 8; an operation room (cab) 7 provided on the front left side of the swing frame 8; a counter weight 9 provided on a rear portion of the swing frame 8; and an engine compartment 6 provided behind the operation room 7 in the swing frame 8. The engine compartment 6 houses an engine 80, which is a motive power source, and hydraulic equipment such as a hydraulic pump driven by the engine 80. The work implement 10 is pivotably coupled to the front middle of the swing frame 8.

The work implement 10 is an articulated-type work implement having a plurality of pivotably coupled driven members, and a plurality of hydraulic cylinders that drive the driven members. In the present embodiment, as three driven members, a boom 11, an arm 12, and a bucket 13 are coupled in series. The boom 11 has a base end portion that is pivotably coupled to a front portion of the swing frame 8 by a boom pin 11*b*. The arm 12 has a base end portion that is pivotably coupled to a tip portion of the boom 11 by an arm pin 12*b*. The bucket 13 is pivotably coupled to a tip portion of the arm 12 by a bucket pin 13*b*. The boom pin 11*b*, the arm pin 12*b*, and the bucket pin 13*b* are arranged in parallel with each other, and the driven members of the work implement 10 can rotate relative to each other on the same plane.

The boom 11 is driven by a hydraulic cylinder (hereinafter, written also as a boom cylinder 11*a*), which is an actuator, and pivots relative to the swing frame 8. The arm 12 is driven by a hydraulic cylinder (hereinafter, written also as an arm cylinder 12*a*), which is an actuator, and pivots relative to the boom 11. The bucket 13 is driven by a hydraulic cylinder (hereinafter, written also as a bucket cylinder 13*a*), which is an actuator, and pivots relative to the arm 12.

The outer surface of the operation room 7 is provided with an external notification buzzer 23 which is a notification device that gives a notification to the outside of the hydraulic excavator 1. The external notification buzzer 23 is a sound output device that outputs sound to thereby give a notification to workers around the hydraulic excavator 1. The periphery of the swing structure 3 is provided with external notification lights 22 which are notification devices that give notifications to the outside of the hydraulic excavator 1. The external notification lights 22 are provided on the left surface, right surface, and rear surface of the swing structure 3. The external notification lights 22 are light emitting devices that emit beams to give notifications to workers around the hydraulic excavator 1. The external notification lights 22 include a plurality of light emitting diodes (LEDs).

Figure 2:
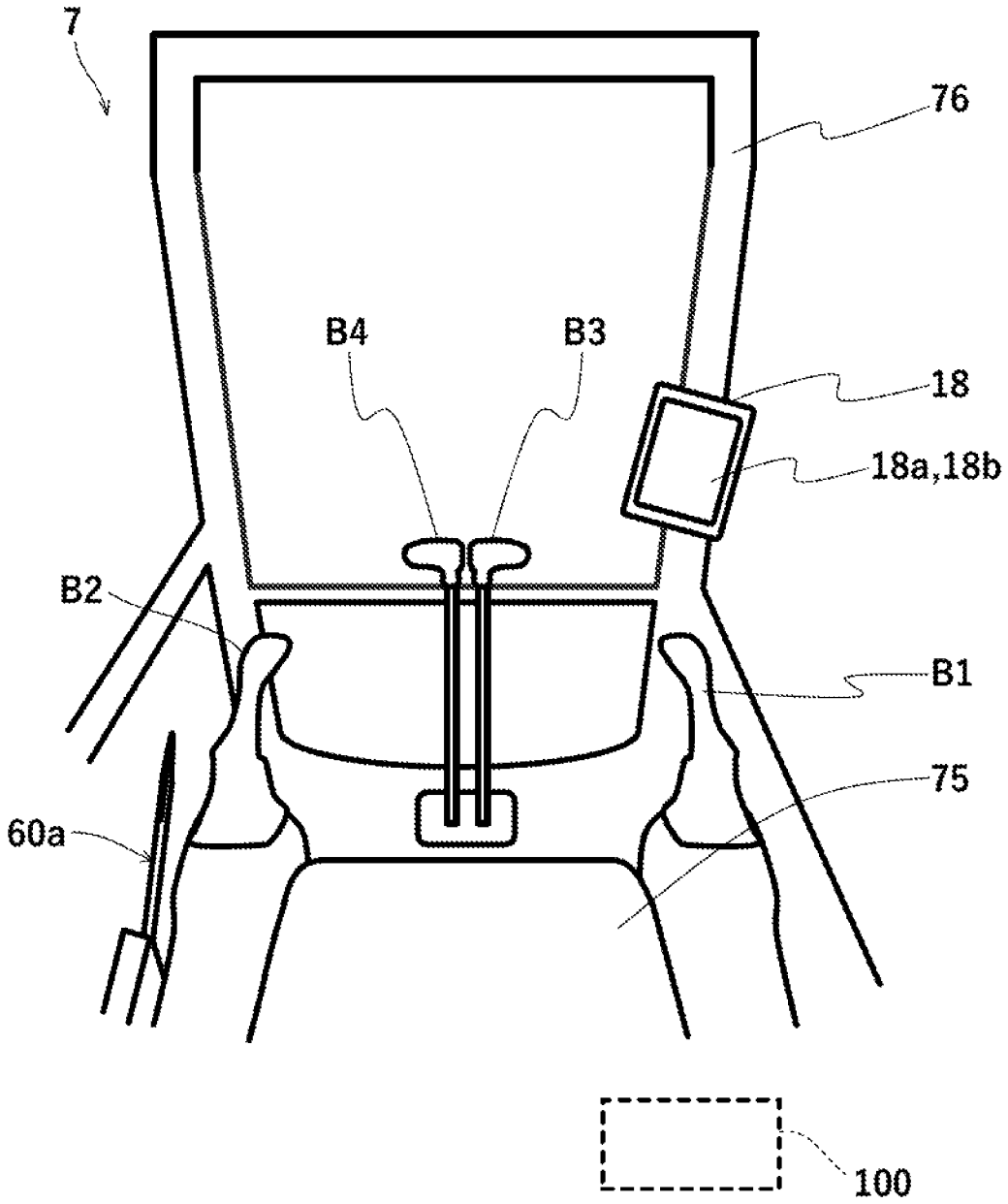
FIG. 2 is a schematic diagram of the inside of an operation room as seen from the backside of an operator's seat in the forward direction.

FIG. 2 is a schematic diagram of the inside of an operation room 7 as seen from the backside of an operator's seat 75 in the forward direction. As depicted in FIG. 2, in the operation room 7, the operator's seat 75 which an operator sits on, operation levers (B1 to B4) for operating portions of the hydraulic excavator 1, a controller 100 that controls operation of the hydraulic excavator 1, and a touch panel monitor 18 that causes predetermined display images to be displayed on its display screen on the basis of signals from the controller 100 are provided. The touch panel monitor 18 is attached to a right pillar 76 as seen from the operator's seat 75. The controller 100 is provided behind the operator's seat 75 in the operation room 7.

On the right side of the operator's seat 75, the right operation lever B1 for performing operation of the bucket 13 and operation of the boom 11 is provided, and on the left side of the operator's seat 75, the left operation lever B2 for performing operation of the swing structure 3 and operation of the arm 12 is provided. On the front side of the operator's seat 75, a pair of left and right travel levers (the left travel lever B4 and the right travel lever B3) are provided. The left travel lever B4 is an operation lever for performing operation of the left crawler, and the right travel lever B3 is an operation lever for performing operation of the right crawler.

A gate lock lever 60*a* is provided on the left side of the left operation lever B2 (on the side closer to a door). The gate lock lever 60*a* is a member that can be selectively operated to be at a lock position (raised position) for permitting exit and entry from and to the operation room 7, and an unlock position (lowered position) for prohibiting exit and entry from and to the operation room 7.

The touch panel monitor 18 has a display section 18*a* that displays various types of information to thereby present the information to an operator, and an input section 18*b* for performing various types of setting of the hydraulic excavator 1. The touch panel monitor 18 is connected to the controller 100. For example, the display section 18*a* is a liquid crystal display, and displays, on its display screen, display images representing various types of information such as activation information about the hydraulic excavator 1 on the basis of control signals from the controller 100. For example, the input section 18*b* is a touch sensor on which input operation by fingers, a touch pen, and the like is possible, and inputs, to the controller 100, predetermined information according to operation by an operator. That is, the touch panel monitor 18 functions as an input device that is operated by an operator, and inputs, to the controller 100, signals according to the operation.

Figure 3:
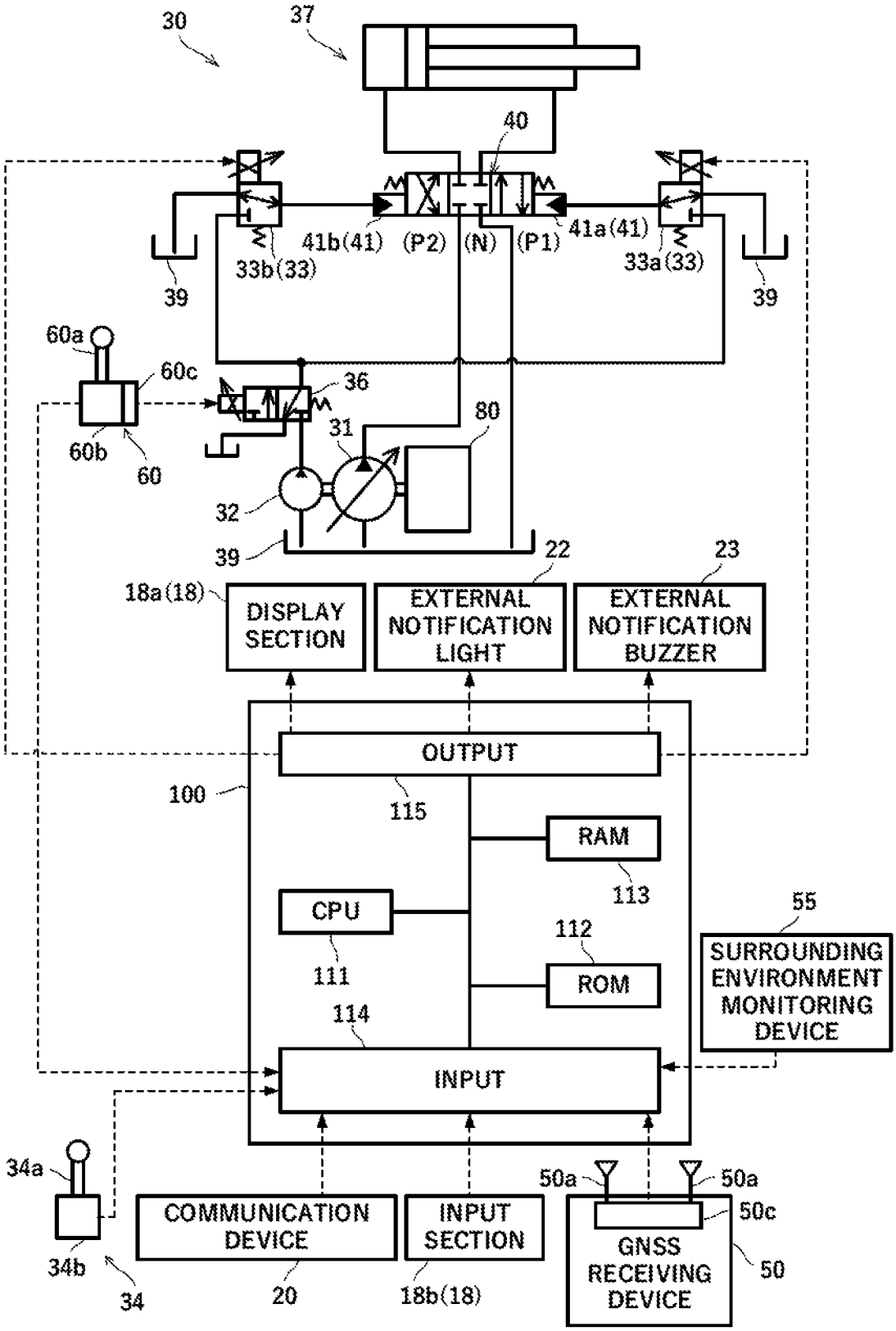
FIG. 3 is a figure depicting a hydraulic system and a controller mounted on the hydraulic excavator.

FIG. 3 is a figure depicting a hydraulic system 30 and the controller 100 mounted on the hydraulic excavator 1. Note that the travel motors (hydraulic motors) 2*a*, the swing motor (hydraulic motor) 3*a*, the boom cylinder (the hydraulic cylinder) 11*a*, the arm cylinder (hydraulic cylinder) 12*a*, and the bucket cylinder (hydraulic cylinder) 13*a* mounted on the hydraulic excavator 1 are written also as hydraulic actuators collectively below. Whereas the hydraulic system 30 is provided with a plurality of hydraulic actuators, FIG. 3 representatively depicts a hydraulic cylinder 37 (e.g. the boom cylinder 11*a*) for driving a driven member of the work implement 10. In addition, whereas an electric operation device 34 for operating a hydraulic actuator and solenoid proportional valves 33*a* and 33*b* and a flow rate control valve 40 that are driven according to operation of the operation device 34 are provided for each of a plurality of hydraulic actuators, FIG. 3 representatively depicts only configurations for controlling one hydraulic actuator.

The hydraulic system 30 includes: a main pump 31 and a pilot pump 32; the hydraulic cylinder 37 driven by a hydraulic working fluid as a working fluid delivered from the main pump 31; the flow rate control valve 40 that controls the flow of the hydraulic working fluid from the main pump 31 to the hydraulic cylinder 37; and the solenoid proportional valves 33*a* and 33*b* (33) that generate command pilot pressures to pressure-receiving sections 41*a* and 41*b* (41) of the flow rate control valve 40.

The main pump 31 and the pilot pump 32 are connected to the engine 80, and driven by the engine 80 to deliver the hydraulic working fluid (hydraulic fluid). The main pump 31 is a variable displacement hydraulic pump, and the pilot pump 32 is a fixed displacement hydraulic pump. The engine 80 is a motive power source of the hydraulic excavator 1, and includes an internal combustion engine such as a diesel engine.

The solenoid proportional valves 33*a* and 33*b* are pressure reducing valves that generate command pilot pressures to be output to the pressure-receiving sections 41*a* and 41*b* of the flow rate control valve 40 by using, as a source pressure, the delivery pressure (hydraulic) of the pilot pump 32, which is a pilot hydraulic pressure source. The solenoid proportional valves 33*a* and 33*b* are controlled on the basis of signals from the controller 100. The operation device 34 gives instructions about operation of the work implement 10, the swing structure 3 and the travel structure 2 according to operation by an operator, and has an operation lever (operation member) 34*a* that can be operated to be inclined, and an operation sensor 34*b* that outputs, to the controller 100, a signal according to the operation amount (operation angle) of the operation lever 34*a*. The controller 100 controls the solenoid proportional valves 33*a* and 33*b* on the basis of the signal from the operation device 34.

When the command pilot pressure generated by the solenoid proportional valve 33*a* acts on the pressure-receiving section 41*a* of the flow rate control valve 40 positioned at a neutral position (N), the flow rate control valve 40 is driven in one direction, and the flow rate control valve 40 is switched from the neutral position (N) to a first position (P1). Thereby, the hydraulic fluid delivered from the main pump 31 is introduced to the bottom chamber of the hydraulic cylinder 37 (boom cylinder 11*a*), also the hydraulic working fluid is discharged from the rod chamber to a tank 39, and the hydraulic cylinder 37 (boom cylinder 11*a*) is extended. As a result, the driven member (boom 11) pivots in a first direction (upward direction).

When the command pilot pressure generated by the solenoid proportional valve 33*b* acts on the pressure-receiving section 41*b* of the flow rate control valve 40 positioned at a neutral position (N), the flow rate control valve 40 is driven in the other direction, and the flow rate control valve 40 is switched from the neutral position (N) to a second position (P2). Thereby, the hydraulic fluid delivered from the main pump 31 is introduced to the rod chamber of the hydraulic cylinder 37 (boom cylinder 11*a*), also the hydraulic working fluid is discharged from the bottom chamber to the tank 39, and the hydraulic cylinder 37 (boom cylinder 11*a*) is retracted. As a result, the driven member (boom 11) pivots in a second direction (downward direction).

The hydraulic working fluid delivered from the main pump 31 is supplied to the hydraulic cylinder 37 through the flow rate control valve 40, and the work implement 10 is driven. Note that, although not depicted, the hydraulic working fluid delivered from the main pump 31 is supplied to the swing motor 3*a* and the travel motors 2*a* through the flow rate control valve, and the swing structure 3 and the travel structure 2 are driven.

A gate lock lever device 60 has: the gate lock lever 60*a*; a shut-off relay 60*c* for supplying or interrupting electrical power from a battery (not depicted); and an operation position sensor 60*b* that senses the operation position of the gate lock lever 60*a*, and outputs the operation position to the controller 100. On a pilot line between the pilot pump 32 and the solenoid proportional valves 33, a solenoid selector valve (hereinafter, written as a lock valve) 36 that is switched between a communication position for establishing communication through the pilot line, and an interruption position for interrupting communication through the pilot line, according to the operation position of the gate lock lever 60*a*, is provided.

When the gate lock lever 60*a* is operated to be at the unlock position (lowered position), the shut-off relay 60*c* is turned on (closed state), and electrical power is supplied from a battery (not depicted) to the lock valve 36. Thereby, the lock valve 36 is switched to the communication position. Because of this, in a state in which the gate lock lever 60*a* is at the unlock position, a command pilot pressure according to the operation amount of the operation lever 34*a* is generated by the solenoid proportional valve 33, and the hydraulic actuator corresponding to the operated operation lever 34*a* is operated. That is, when the gate lock lever 60*a* is operated to be at the unlock position (lowered position), operation of the actuator by the operation device 34 is enabled.

When the gate lock lever 60*a* is operated to be at the lock position (raised position), the shut-off relay 60*c* is turned off (opened state), and the supply of electrical power from the battery (not depicted) to the lock valve 36 is interrupted. Thereby, the lock valve 36 is switched to the interruption position. Because of this, the pilot source pressure to the solenoid proportional valve 33 is interrupted, and operation by the operation lever 34*a* is disabled. That is, when the gate lock lever 60*a* is operated to be at the lock position (raised position), operation of the actuator by the operation device 34 is disabled.

The hydraulic excavator 1 includes: the controller 100 which is a controller that controls pieces of equipment such as the touch panel monitor 18, external notification light 22, external notification buzzer 23, and solenoid proportional valve 33 mounted on the hydraulic excavator 1; a communication device 20 that performs wireless communication with the mobile terminal 5 (see FIG. 1); a GNSS receiving device S0 that computes the azimuth and position of the hydraulic excavator 1 by using a GNSS (Global Navigation Satellite System: global navigation satellite system); and a surrounding environment monitoring device 55 having a plurality of cameras.

The controller 100 is configured by using a microcomputer including: a CPU (Central Processing Unit) 111 as an operation circuit; a ROM (Read Only Memory) 112 as a storage device; a RAM (Random Access Memory) 113 as a storage device; an input interface 114 and an output interface 115; and other peripheral circuits. The controller 100 may be configured by using one microcomputer or may be configured by using a plurality of microcomputers. The ROM 112 of the controller 100 is a non-volatile memory such as an EEPROM, and has stored thereon programs that can execute various types of computation. That is, the ROM 112 of the controller 100 is a storage medium that can read out programs to realize functionalities according to the present embodiment. The RAM 113 is a volatile memory, and is a work memory that performs data input and output directly with the CPU 111. The RAM 112 temporarily stores data that is necessary while the CPU 111 is executing computation according to a program. Note that the controller 100 may further include storage devices such as a flash memory and a hard disk drive.

The CPU 111 is a processing device that loads a control program stored on the ROM 112 onto the RAM 113 and executes computation, and performs predetermined computation processes on signals taken in from the input interface 114, the ROM 112, and the RAM 113 according to the control program. The input interface 114 receives input of signals from the communication device 20, the input section 18*b*, the GNSS receiving device 50, the surrounding environment monitoring device 55, the operation sensor 34*b* of the operation device 34, and the operation position sensor 60*b* of the gate lock lever device 60. The input interface 114 converts the input signals into a format in which the CPU 111 can perform computation. The output interface 115 generates signals for output according to results of the computation at the CPU 111, and outputs the signals to the solenoid proportional valves 33*a* and 33*b* of the hydraulic system 30, the display section 18*a*, the external notification light 22, the external notification buzzer 23, and the like.

For example, the communication device 20 has a communication interface including a communication antenna whose sensitivity band is bands such as the 2.4 GHz band or the 5 GHz band. The communication device 20 exchanges information (data) directly with the wireless communication device 52 mounted on the mobile terminal 5, bypassing a wireless base station. The communication device 20 is a wireless LAN router that performs wireless communication with the wireless communication device 52 of the mobile terminal 5 on the basis of Wi-Fi (registered trademark) which is a wireless communication method based on, for example, the IEEE (The Institute of Electrical and Electronics Engineers, Inc.) 802.11 standard. Note that the communication method is not limited to this, but, for example, a communication method such as ZigBee (registered trademark) or Bluetooth (registered trademark) can also be adopted. Note that the hydraulic excavator 1 and the mobile terminal 5 may exchange information indirectly via a wireless base station or the like connected to a wide area network such as a mobile phone communication network.

The GNSS receiving device 50 includes a pair of left and right GNSS antennas 50*a* attached to a rear portion of the swing structure 3. The GNSS antennas 50*a* function as position sensors that sense the position of the swing structure 3. The GNSS receiving device 50 includes a computing device 50*c* that computes the position and azimuth of the swing structure 3 in a global coordinate system on the basis of information from the GNSS antennas 50*a*.

The surrounding environment monitoring device 55 includes cameras that capture images of spaces in front of, on the left side of, on the right side of, and behind the swing structure 3. The controller 100 acquires images captured by the cameras, performs lens distortion correction on the acquired images, and further performs a viewpoint conversion process for conversion into an image as seen from the viewpoint from above. The controller 100 synthesizes the image having been subjected to the viewpoint conversion process, and an illustration of the hydraulic excavator 1, and generates a bird's-eye view image 191 (see FIG. 15). The controller 100 causes the generated bird's-eye view image 191 to be displayed on the display screen of the touch panel monitor 18.

The controller 100 according to the present embodiment causes the external notification light 22 and the external notification buzzer 23 to give notifications in predetermined modes of notification such that a worker performing work around the hydraulic excavator 1 can easily judge whether or not she/he is allowed to enter a movable range of the hydraulic excavator 1. The predetermined modes of notification are decided by the controller 100 in accordance with the degree of interpersonal communication between an operator of the hydraulic excavator 1 and the worker performing work around the hydraulic excavator 1. The degree of interpersonal communication is decided depending on a result of a determination whether or not the communication device 20 has received a signal (hereinafter, an approval request) for requesting approval (permission) to enter the movable range of the hydraulic excavator 1 transmitted from the mobile terminal 5 when the worker operates the mobile terminal 5, and a result of a determination whether or not the operator has performed approval operation for approving (permitting) entry into the movable range by the worker on the touch panel monitor 18.

The controller 100, when the worker has made the approval request for entry into the movable range, controls the notification devices (22 and 23) such that notifications are given in modes of notification for informing the worker that the approval operation by the operator of the hydraulic excavator 1 is being waited for. In addition, the controller 100 controls the notification devices (22 and 23) such that notifications are given in modes of notification for informing the worker that the operator has performed the approval operation for approving (permitting) entry into the movable range when the operator has performed the approval operation. In this manner, the controller 100 according to the present embodiment gives notifications by using the notification devices (22 and 23) in modes of notification according to the degree of interpersonal communication between the operator of the hydraulic excavator 1 and the worker around the hydraulic excavator 1. Detailed explanations are given below.

Figure 4:
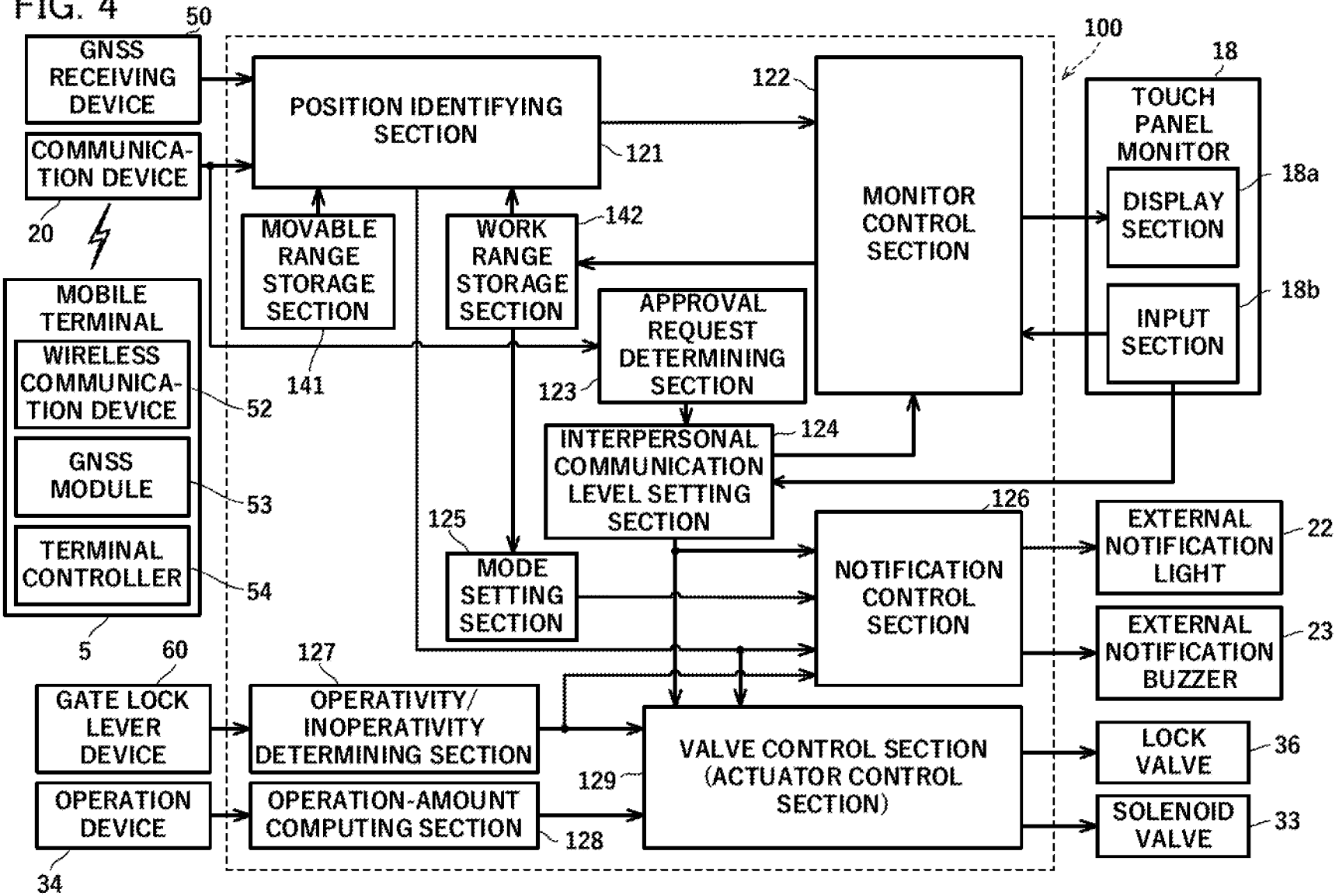
FIG. 4 is a functional block diagram of the controller.

FIG. 4 is a functional block diagram of the controller 100. As depicted in FIG. 4, the controller 100, by executing programs stored on the ROM 112, functions as a position identifying section 121, a monitor control section 122, an approval request determining section 123, an interpersonal communication level deciding section 124, a mode setting section 125, a notification control section 126, an operativity/inoperativity determining section 127, an operation-amount computing section 128, and a valve control section (actuator control section) 129.

The position identifying section 121, on the basis of information (hereinafter, written also as excavator positional information) about the position and azimuth of the hydraulic excavator 1 in the global coordinate system output from the GNSS receiving device 50, and information (hereinafter, written also as worker positional information) about the position of the mobile terminal 5 in the global coordinate system output from the communication device 20, computes a relative position of the mobile terminal 5 relative to the hydraulic excavator 1, that is, a position of the worker as measured from the excavator. In this manner, in the present embodiment, the GNSS receiving device 50, the communication device 20, and the controller 100 function as a worker position sensor that senses the position of a worker around the hydraulic excavator 1.

The position identifying section 121 determines whether or not the worker is present inside a movable range on the basis of the position of the worker as measured from the excavator, and information about the movable range stored on a movable range storage section 141, which is a storage area of the ROM 112. In addition, the position identifying section 121 determines whether or not the worker is present inside a work range on the basis of the position of the worker as measured from the excavator, and information about the work range stored on a work range storage section 142, which is a storage area of the ROM 112.

The position identifying section 121, on the basis of a result of the determination described above, identifies the position of the worker, and stores, on a position storage section, which is a storage area of the ROM 112, a worker position table on which the identified position of the worker and a terminal ID are associated with each other. FIG. 7A is a figure depicting the worker position table. For each terminal ID, the position identifying section 121 identifies the position of a worker, and stores positional information (hereinafter, written also as position identifying information) about the identified worker in association with the terminal ID.

When it is determined that the worker is present outside the movable range, the position identifying section 121 sets the position of the worker as "OUTSIDE MOVABLE RANGE" in association with the terminal ID of the mobile terminal 5 of the worker. When it is determined that the worker is present inside the movable range, and additionally it is determined that the worker is present outside the work range, the position identifying section 121 sets the position of the worker as "INSIDE MOVABLE RANGE" in association with the terminal ID of the mobile terminal 5 of the worker. When it is determined that the worker is present inside the work range, the position identifying section 121 sets the position of the worker as "INSIDE WORK RANGE" in association with the terminal ID of the mobile terminal 5 of the worker.

Figure 5:
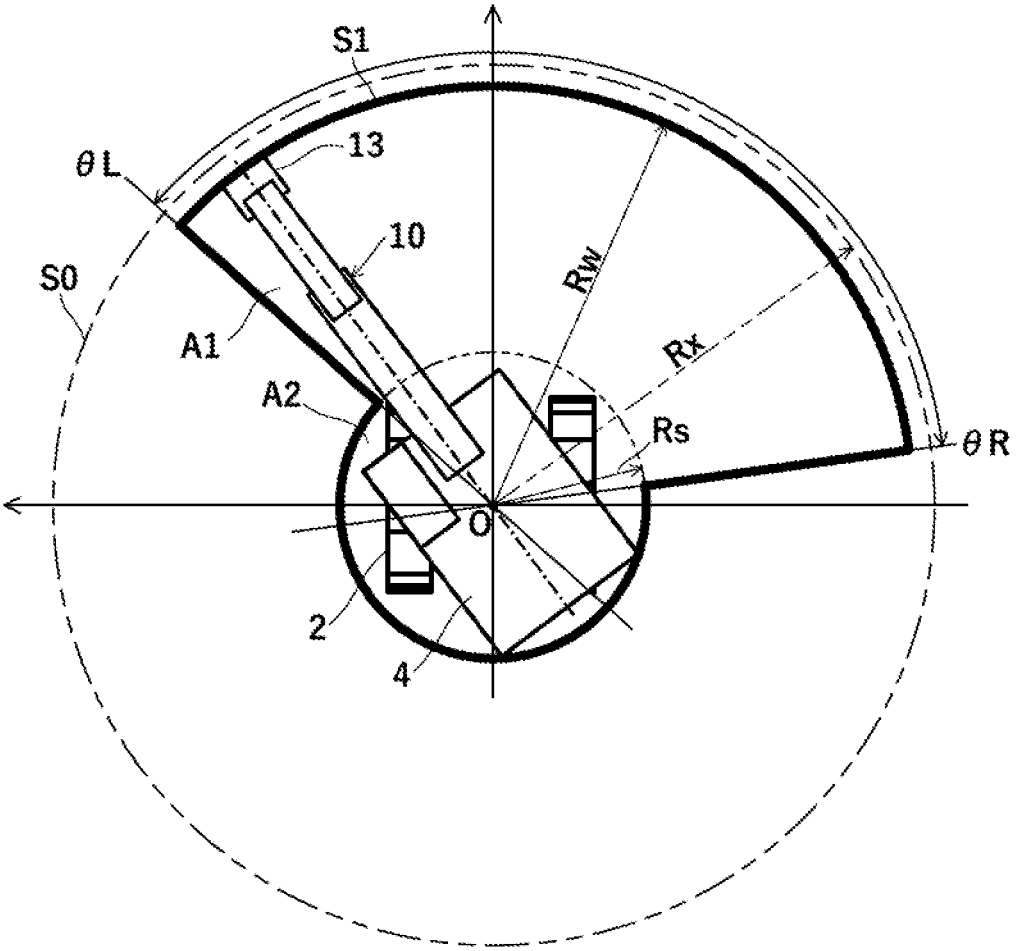
FIG. 5 is a figure of the hydraulic excavator as seen from above, and depicts a movable range and a work range of the hydraulic excavator.

FIG. 5 is a figure of the hydraulic excavator 1 as seen from above, and depicts a movable range S0 and a work range S1 of the hydraulic excavator 1. As depicted in FIG. 5, the movable range S0 is a circular range with a maximum swing radius Rx of the hydraulic excavator 1. The maximum swing radius Rx is equivalent to the length from a swing center axis O of the swing structure 3 to the tip of the bucket 13 when the work implement 10 is extended forward (in a direction orthogonal to the swing center axis). Stated differently, the maximum swing radius Rx is equivalent to the length from the swing center axis O to the maximum reachable position of the work implement 10 in the direction orthogonal to the swing center axis O. Note that whereas the movable range S0 is the circular range with the maximum swing radius Rx in the present embodiment, the movable range S0 may be a circular range with a radius obtained by adding a tolerance to the maximum swing radius Rx. The movable range S0 is predetermined on the basis of the dimension of each portion of the hydraulic excavator 1, and is stored on the movable range storage section 141 of the ROM 112.

The work range S1 is a range set in the movable range S0, and is a range that can be set as desired by the operator operating the touch panel monitor 18. The monitor control section 122 sets the work range S1 on the basis of an input signal from the touch panel monitor 18. The monitor control section 122 sets a left swing limit angle θL defining the left end of the work range S1, and a right swing limit angle θR defining the right end of the work range S1. In addition, the monitor control section 122 sets a work radius Rw defining the maximum radius of the work range.

Figure 6:
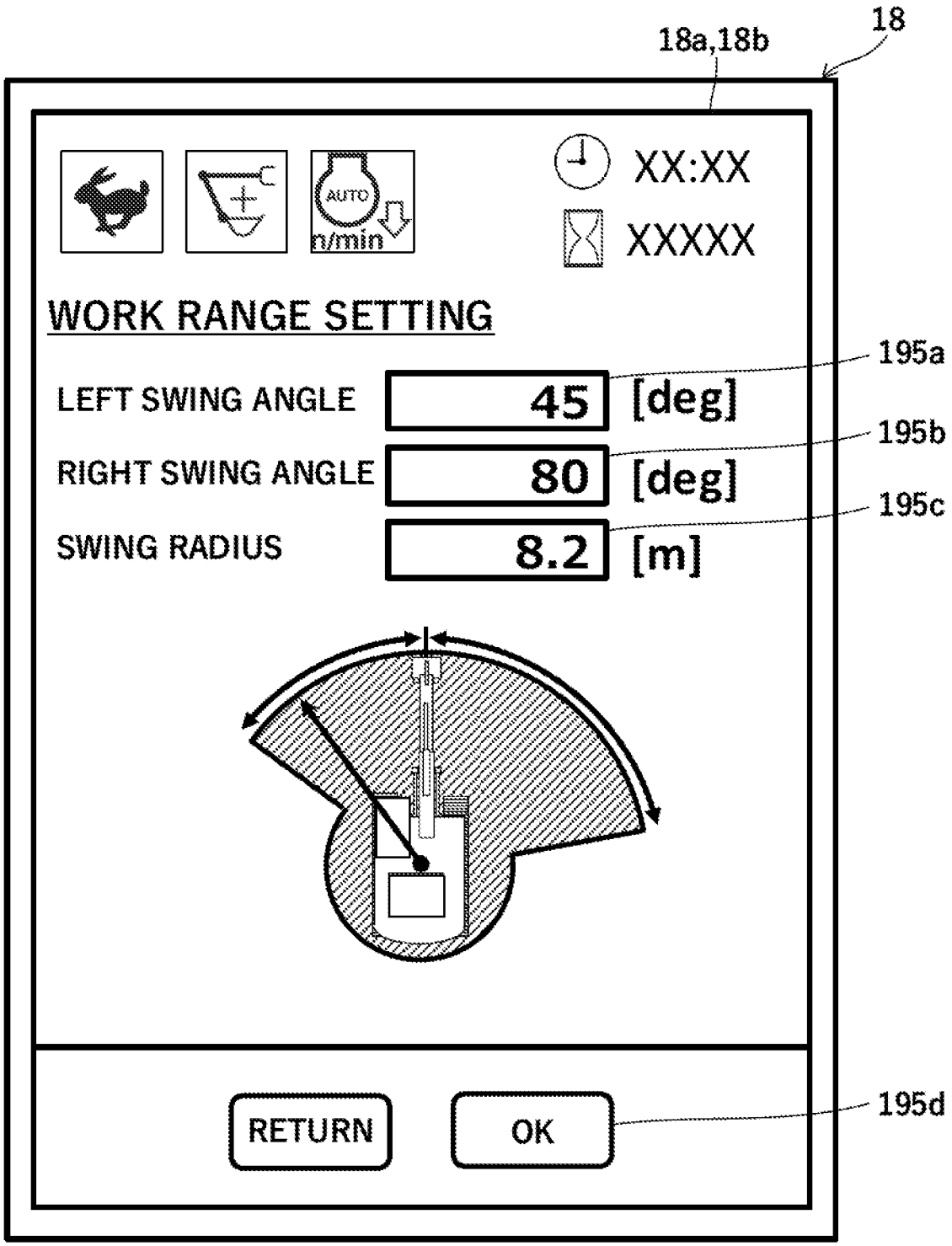
FIG. 6 is a figure depicting a work range setting screen of a touch panel monitor.

A work range setting method is explained. In the present embodiment, the touch panel monitor 18 functions as a work range setting device for setting the work range S1. When predetermined operation is performed on the touch panel monitor 18, a work range setting screen is displayed. FIG. 6 is a figure depicting the work range setting screen of the touch panel monitor 18. As depicted in FIG. 6, the setting screen displayed on the touch panel monitor 18 includes: a left swing angle input section 195*a* for inputting the left swing limit angle θL (see FIG. 5); a right swing angle input section 195*b* for inputting the right swing limit angle θR (see FIG. 5); and a swing radius input section 195*c* for inputting the work radius Rw (see FIG. 5).

The operator can set the work range by inputting numerical values by touch operation on the left swing angle input section 195*a*, the right swing angle input section 195*b*, and the swing radius input section 195*c*, and performing touch operation on a deciding section 195*d*. When work range setting operation by the operator is performed on the setting screen depicted in FIG. 6, the monitor control section 122 sets the work range S1. In the present embodiment, as depicted in FIG. 5, an area obtained by synthesizing a fan-shaped area A1 in front of the swing structure 3 defined by the left swing limit angle θL, the right swing limit angle θR, and the work radius Rw, and a circular area A2 with a radius Rs which is equal to the distance from the swing center axis O to the outermost circumferential portion of the swing structure 3 is set as the work range S1. The work range S1 is stored on the work range storage section 142 of the ROM 112. Thereby, the work range S1 has been set in the current state.

Note that the operator performs operation of setting a new work range S1 by using the touch panel monitor 18 when she/he wants to change the work range S1. Thereby, the monitor control section 122 performs a process of updating information about the work range S1 stored on the work range storage section 142. In addition, the operator performs operation of canceling the set work range S1 by using the touch panel monitor 18 when she/he wants to cancel the set work range S1. Thereby, the monitor control section 122 performs a process of deleting information about the work range S1 stored on the work range storage section 142. Thereby, the work range S1 has not been set in the current state.

When the work range S1 has been set, operation of the hydraulic excavator 1 is tolerated only in the work range S1, and such operation that the hydraulic excavator 1 partially goes out of the work range S1 is prohibited. For example, where operation for causing the swing structure 3 to swing left is performed, and the operation amount is maintained at a predetermined operation amount (the maximum operation amount, etc.), the swing structure 3 performs left swing operation, but the speed of the swing structure 3 lowers as the swing angle approaches the left swing limit angle θL, and the left swing operation is stopped when the swing angle has reached the left swing limit angle θL. In addition, the same applies to the work implement 10 also, and when such operation that the work implement 10 goes out of the work radius Rw is performed, the work implement 10 is stopped. In this manner, control for prohibiting such operation that the hydraulic excavator 1 partially goes out of the work range S1 is performed by the controller 100 on the basis of information from a posture sensor that senses the posture of the hydraulic excavator 1. The posture sensor includes: a boom angle sensor that senses the angle of the boom 11 relative to the swing structure 3; an arm angle sensor that senses the angle of the arm 12 relative to the boom 11; a bucket angle sensor that senses the angle of the bucket 13 relative to the arm 12; and a swing angle sensor that senses the angle (swing angle) of the swing structure 3 relative to the travel structure 2.

Figure 8:
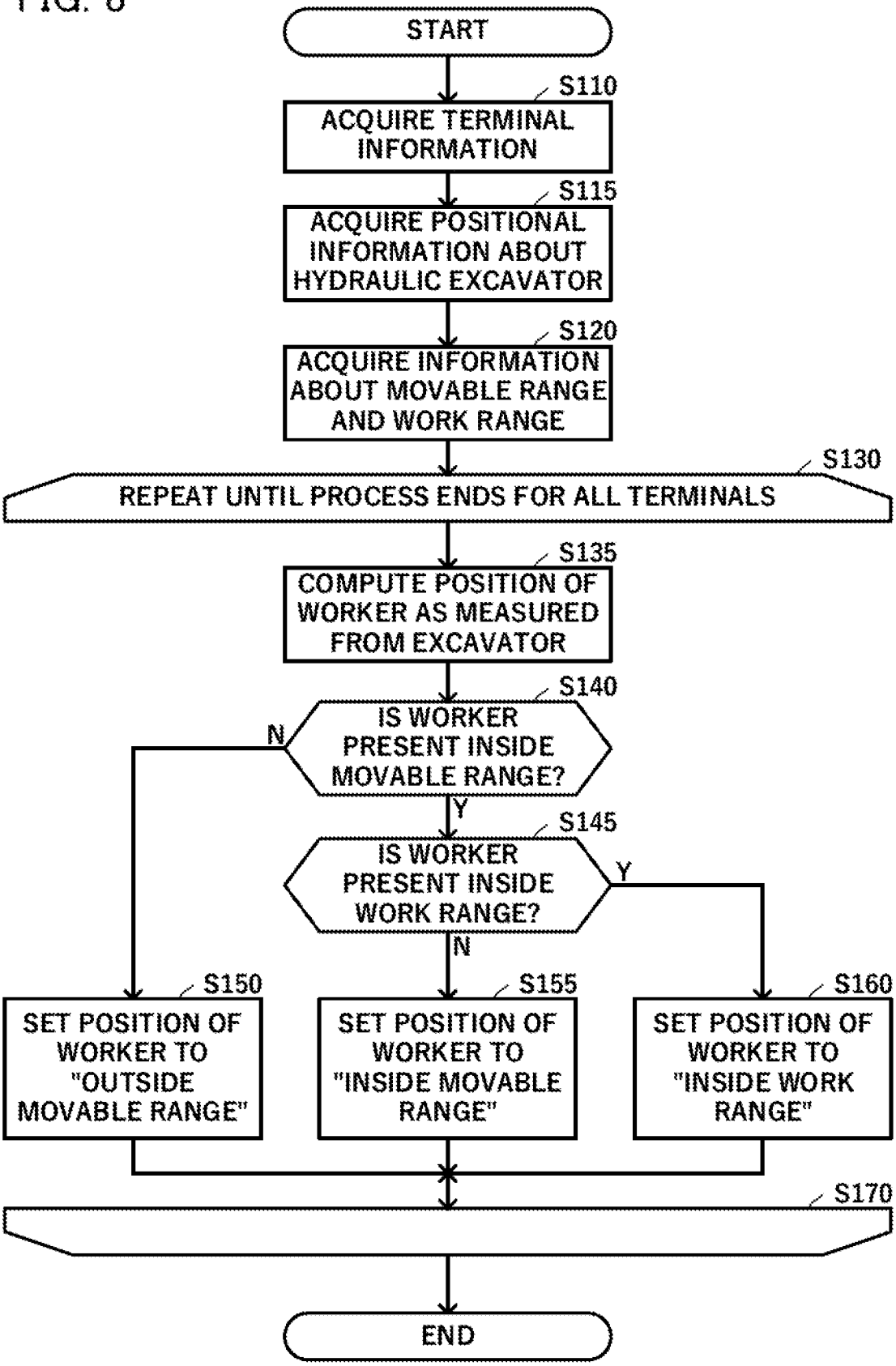
FIG. 8 is a flowchart depicting a position identifying process executed by the controller.

FIG. 8 is a flowchart depicting a position identifying process executed by the controller (position identifying section 121). For example, the process in the flowchart depicted in FIG. 8 is started when a mobile terminal 5 and the communication device 20 are connected to each other by wireless communication, and is executed repeatedly at predetermined intervals.

As depicted in FIG. 8, at Step S110, the position identifying section 121 acquires terminal information about all mobile terminals 5 connected by wireless communication, and proceeds to Step S115. The terminal information about the mobile terminals 5 includes information such as terminal IDs which are unique information for identifying the mobile terminals 5, information (worker positional information) about the positions of the mobile terminals 5 in the global coordinate system, and approval requests for entry into the movable range S0.

At Step S115, the position identifying section 121 acquires information (excavator positional information) about the position and azimuth of the hydraulic excavator 1 in the global coordinate system from the GNSS receiving device 50, and proceeds to Step S120.

At Step S120, the position identifying section 121 acquires information about the movable range S0 from the movable range storage section 141, and also acquires information about the work range S1 from the work range storage section 142. Upon acquisition of the information about the movable range S0 and work range S1 at Step S120, the position identifying section 121 executes a loop process (Steps S130, S170).

The loop process (Steps S130, S170) ends when the process on all the mobile terminals 5 connected by wireless communication is completed, and when the loop process ends, the process depicted in the flowchart in FIG. 8 ends. A process to be executed in the loop process (Steps S130, S170) is explained below.

At Step S135, the position identifying section 121 computes a relative position of the mobile terminal 5 relative to the hydraulic excavator 1 (a position of the worker as measured from the excavator) on the basis of the worker positional information acquired at Step S110 and the excavator positional information acquired at Step S115, and proceeds to Step S140.

At Step S140, the position identifying section 121 determines whether or not the worker is present inside the movable range S0 on the basis of the position of the worker as measured from the excavator computed at Step S135 and the information about the movable range S0 acquired at Step S120. If it is determined at Step S140 that the worker is present inside the movable range S0, the process proceeds to Step S145, and if it is determined that the worker is not present inside the movable range S0, that is, the worker is present outside the movable range S0, the process proceeds to Step S150.

At Step S145, the position identifying section 121 determines whether or not the worker is present inside the work range S1 on the basis of the position of the worker as measured from the excavator computed at Step S135 and the information about the work range S1 acquired at Step S120. If it is determined that the worker is present inside the work range S1, the process proceeds to Step S160, and if it is determined that the worker is not present inside the work range S1, that is, the worker is present outside the work range S1, the process proceeds to Step S155.

At Step S150, the position identifying section 121 sets the position of the worker to "OUTSIDE MOVABLE RANGE" in association with the terminal ID. At Step S150, the result of the determination that the worker is present outside the movable range is stored on the worker position table (see FIG. 7A). Note that the work range is included in the movable range, thus the determination result representing that the worker is present outside the movable range means that the worker is present outside the work range. At Step S155, the position identifying section 121 sets the position of the worker to "INSIDE MOVABLE RANGE" in association with the terminal ID. At Step S155, the result of the determination that the worker is present inside the movable range, and additionally present outside the work range is stored on the worker position table (see FIG. 7A). At Step S160, the position identifying section 121 sets the position of the worker to "INSIDE WORK RANGE" in association with the terminal ID. At Step S160, the result of the determination that the worker is present inside the movable range, and additionally present inside the work range is stored on the worker position table (see FIG. 7A).

The process depicted in the flowchart in FIG. 8 is executed repeatedly at predetermined control intervals, thus if a worker moves from the outside of the movable range to the movable range, a worker moves from the outside of the work range to the inside of the work range, and so on, the worker position table depicted in FIG. 7A is updated.

The mode setting section 125 depicted in FIG. 4 refers to the work range storage section 142, determines whether or not the work range S1 of the hydraulic excavator 1 has been set, and sets a work mode on the basis of a result of the determination. As mentioned above, when the work range S1 is set, such operation that the hydraulic excavator 1 moves out of the work range S1 is prohibited. That is, workers are allowed to enter the inside of the movable range S0 as long as the inside of the movable range S0 is outside the work range S1. Because of this, if the mode setting section 125 determines that the work range S1 has been set, the mode setting section 125 sets the work mode to an entry-allowing mode. Where the work range S1 has not been set, there is a possibility that the operator operates the hydraulic excavator 1 such that it operates over the entire area of the movable range S0. Because of this, if the mode setting section 125 determines that the work range S1 has not been set, the mode setting section 125 sets the work mode to an entry-prohibiting mode.

A mobile terminal 5, on the basis of operation by a worker, transmits, to the hydraulic excavator 1, an approval request for requesting approval of entry into the movable range S0 of the hydraulic excavator 1. The approval request determining section 123 determines whether or not the communication device 20 has received an approval request transmitted from a mobile terminal 5. The approval request determining section 123 determines, for each mobile terminal 5 connected to the communication device 20 by wireless communication, whether or not an approval request has been received, and stores, on the ROM 112, results of the determinations in a table format.

Specifically, the approval request determining section 123 stores, on an approval status storage section, which is a storage area of the ROM 112, an approval request monitoring table on which information whether or not an approval request has been received is associated with the terminal ID of a mobile terminal 5. FIG. 7B is a figure depicting the approval request monitoring table. Where an approval request from a mobile terminal 5 has not been received, the approval request determining section 123 sets the approval request status to "APPROVAL REQUEST NOT RECEIVED" in association with the terminal ID of the mobile terminal 5. Where an approval request from a mobile terminal 5 has been received, the approval request determining section 123 sets the approval request status to "APPROVAL REQUEST RECEIVED" in association with the terminal ID of the mobile terminal 5.

If the approval request determining section 123 determines that the communication device 20 has received an approval request, as mentioned later, the monitor control section 122 informs the operator that an approval request has been received by displaying, on the display screen of the touch panel monitor 18, a display image representing that an approval request has been received. That is, the touch panel monitor 18 functions as an informing device that informs the operator that approval requests have been received.

The interpersonal communication level deciding section 124 refers to the approval request monitoring table (see FIG. 7B), and determines whether or not approval operation of approving entry into the movable range S0 of the hydraulic excavator 1 has been performed on the touch panel monitor 18. The interpersonal communication level deciding section 124 sets, for each worker (each mobile terminal 5) carrying a mobile terminal 5, an interpersonal communication level representing the degree of interpersonal communication between the operator of the hydraulic excavator 1 and the worker, on the basis of the information (i.e. the results of the determinations whether or not approval requests have been received) in the approval request monitoring table (see FIG. 7B), and the results of the determinations whether or not approval operation has been performed.

The interpersonal communication level deciding section 124 generates an interpersonal communication level table on which the terminal IDs of the mobile terminals 5 and the interpersonal communication levels are associated with each other, and stores the interpersonal communication level table on an interpersonal communication level storage section, which is a storage area of the ROM 112. FIG. 7C is a figure depicting the interpersonal communication level table.

The interpersonal communication level deciding section 124 refers to the approval request monitoring table (see FIG. 7B), and sets, to "1," an interpersonal communication level of a terminal ID for which "APPROVAL REQUEST NOT RECEIVED" is set. The interpersonal communication level deciding section 124 refers to the approval request monitoring table (see FIG. 7B), and determines whether or not approval operation has been performed for a terminal ID for which "APPROVAL REQUEST RECEIVED" is set. Where the interpersonal communication level deciding section 124 determines that approval operation has not been performed, the interpersonal communication level deciding section 124 sets, to "2," an interpersonal communication level in association with the terminal ID. Where the interpersonal communication level deciding section 124 determines that approval operation has been performed, the interpersonal communication level deciding section 124 sets, to "3," an interpersonal communication level in association with the terminal ID.

The higher an interpersonal communication level is, the higher the degree of interpersonal communication between the worker and the operator is. The interpersonal communication level "1" means that both the worker and the operator have taken no action for interpersonal communication. The interpersonal communication level "2" means that the worker has taken action for requesting the operator to approve entry into the movable range S0, and additionally the operator has taken no action for approving the entry of the worker. That is, the interpersonal communication level "2" means that only one-sided expression of intention has been given from the worker to the operator. Note that the case of the interpersonal communication level "2" can be assumed either a case where the operator has not noticed that an approval request has been made from the worker or a case where the operator has noticed that the approval request has been given from the worker, but has not given approval intentionally. The interpersonal communication level "3" means that the worker has taken action for requesting the operator to approve entry into the movable range S0, and additionally the operator has taken action for approving the entry of the worker. That is, the interpersonal communication level "3" means that bidirectional expressions of intention have been given between the worker and the operator.

In this manner, the interpersonal communication level deciding section 124 sets, for each worker (each mobile terminal 5), an interpersonal communication level representing the degree of interpersonal communication between the operator and the worker, depending on whether or not the communication device 20 has received an approval request from the mobile terminal 5 and whether or not approval operation for the approval request has been performed.

Figure 9:
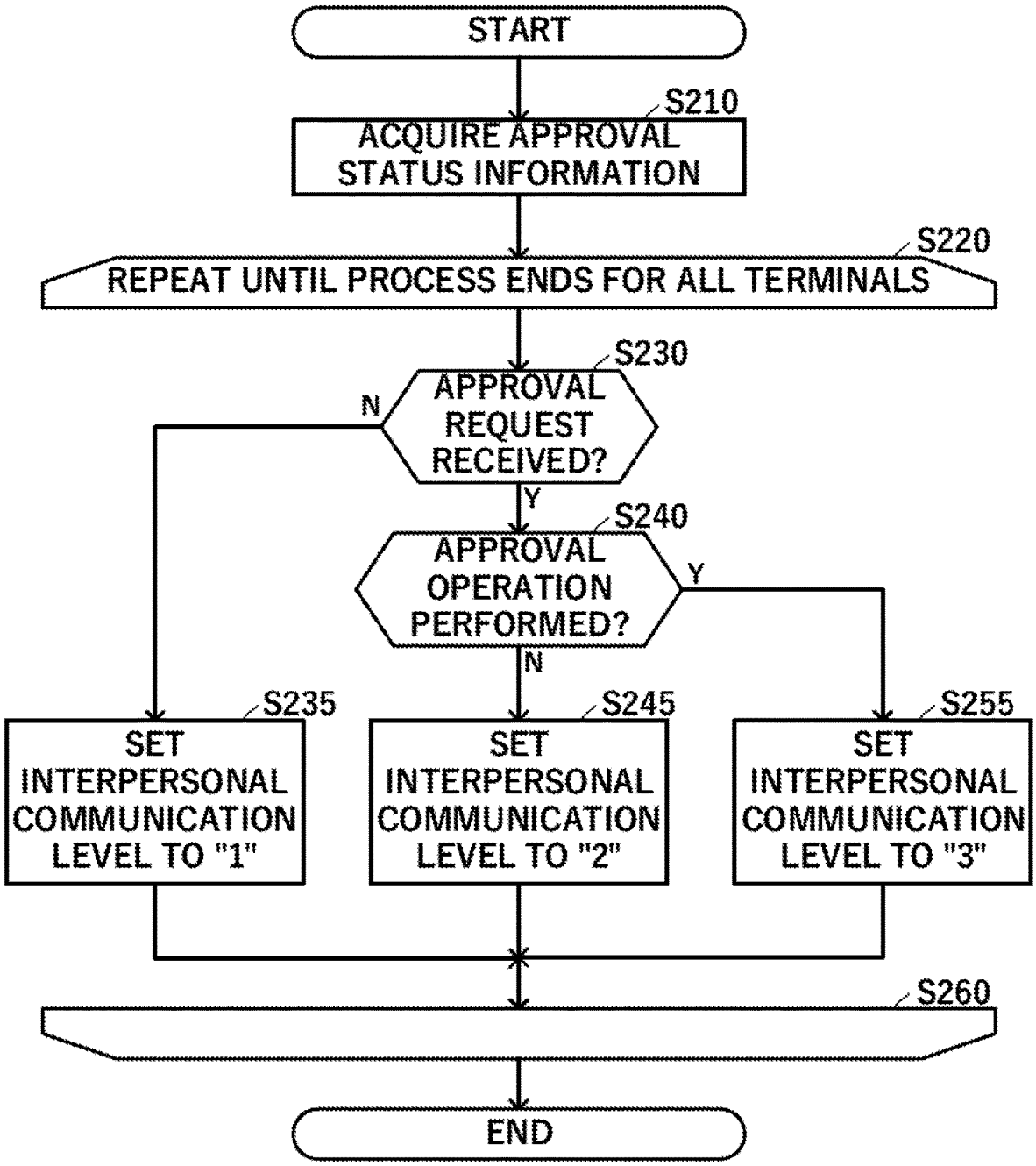
FIG. 9 is a flowchart depicting an interpersonal communication level setting process executed by the controller.

FIG. 9 is a flowchart depicting an interpersonal communication level setting process executed by the controller (interpersonal communication level deciding section 124) 100. For example, the process in the flowchart depicted in FIG. 9 is started when a mobile terminal 5 and the communication device 20 are connected to each other by wireless communication, and is executed repeatedly at predetermined control intervals.

As depicted in FIG. 9, at Step S210, the interpersonal communication level deciding section 124 acquires approval status information (information about whether or not approval requests have been received) stored on the approval request monitoring table (see FIG. 7B). The interpersonal communication level deciding section 124 executes a loop process upon acquisition of the approval status information at Step S210 (Steps S220, S260).

The loop process (Steps S220, S260) ends when the process on all the mobile terminals 5 connected by wireless communication is completed, and when the loop process ends, the process depicted in the flowchart in FIG. 9 ends. A process to be executed in the loop process (Steps S220, S260) is explained below.

At Step S230, the interpersonal communication level deciding section 124 determines whether or not an approval request has been received on the basis of the approval status information acquired at Step S210. If it is determined at Step S230 that an approval request has been received, the process proceeds to Step S240, and if it is determined that an approval request has not been received, the process proceeds to Step S235.

At Step S240, the interpersonal communication level deciding section 124 determines whether or not approval operation for approving entry into the movable range S0 of the hydraulic excavator 1 has been performed on the touch panel monitor 18. If it is determined that approval operation has been performed, the process proceeds to Step S255, and if it is determined that approval operation has not been performed, the process proceeds to Step S245.

At Step S235, the interpersonal communication level deciding section 124 sets the interpersonal communication level to "1" in association with the terminal ID. At Step S245, the interpersonal communication level deciding section 124 sets the interpersonal communication level to "2" in association with the terminal ID. At Step S255, the interpersonal communication level deciding section 124 sets the interpersonal communication level to "3" in association with the terminal ID.

The process depicted in the flowchart in FIG. 9 is executed repeatedly at predetermined control intervals, thus the interpersonal communication level table depicted in FIG. 7C is updated if the state as to whether or not an approval request has been received from a worker or whether or not approval operation has been performed by the operator changes.

The monitor control section 122 depicted in FIG. 4 refers to the worker position table (see FIG. 7A) on which the position identifying information about the workers identified by the position identifying section 121 is stored, and the interpersonal communication level table (see FIG. 7C) on which the interpersonal communication levels decided by the interpersonal communication level deciding section 124 are stored, and controls display images on the display section 18*a* of the touch panel monitor 18 on the basis of the worker position identifying information and interpersonal communication levels.

Figure 10:
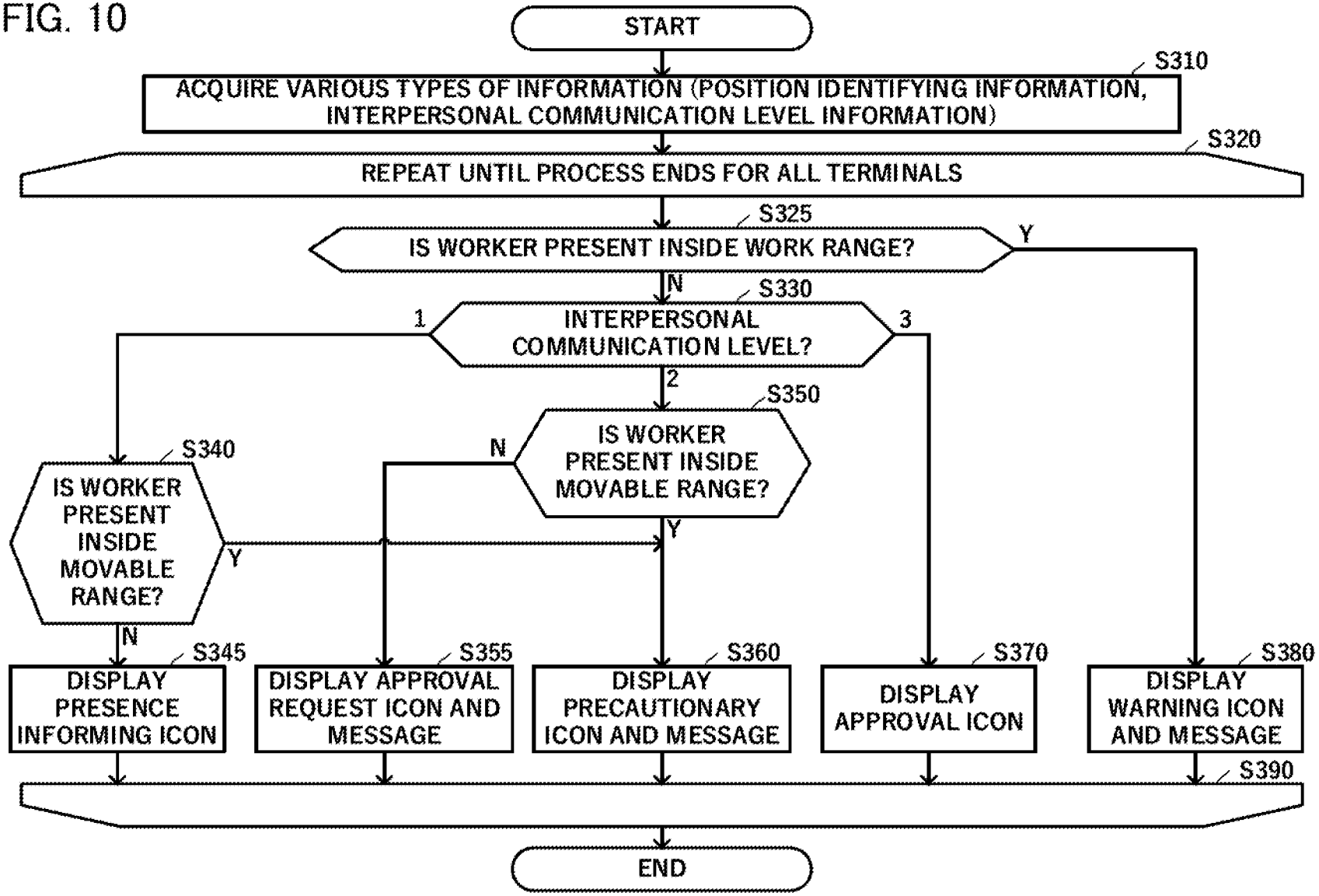
FIG. 10 is a flowchart depicting an informing process executed by the controller.

FIG. 10 is a flowchart depicting an informing process executed by the controller (monitor control section 122) 100. For example, the process in the flowchart depicted in FIG. 10 is started when a mobile terminal 5 and the communication device 20 are connected to each other by wireless communication, and is executed repeatedly at predetermined control intervals.

As depicted in FIG. 10, at Step S310, the monitor control section 122 acquires the worker position identifying information stored on the worker position table (see FIG. 7A). In addition, at Step S310, the monitor control section 122 acquires the interpersonal communication level information stored on the interpersonal communication level table (see FIG. 7C). Upon acquisition of the worker position identifying information and interpersonal communication level information at Step S310, the monitor control section 122 executes a loop process (Steps S320, S390).

The loop process (Steps S320, S390) ends when the process on all the mobile terminals 5 connected by wireless communication is completed, and when the loop process ends, the process depicted in the flowchart in FIG. 10 ends. A process to be executed in the loop process (Steps S320, S390) is explained below.

At Step S325, the monitor control section 122 determines whether or not the worker is present inside the work range S1 on the basis of the worker position identifying information acquired at Step S310. If it is determined at Step S325 that the worker is not present inside the work range S1, that is, the worker is present outside the work range S1, the process proceeds to Step S330, and if it is determined that the worker is present inside the work range S1, the process proceeds to Step S380.

At Step S330, the monitor control section 122 determines which of "1," "2," and "3" the interpersonal communication level is on the basis of the interpersonal communication level information acquired at Step S310. If it is determined at Step S330 that the interpersonal communication level is "1," the process proceeds to Step S340. If it is determined at Step S330 that the interpersonal communication level is "2," the process proceeds to Step S350. If it is determined at Step S330 that the interpersonal communication level is "3," the process proceeds to Step S370.

At Step S340, the monitor control section 122 determines whether or not the worker is present inside the movable range S0 on the basis of the worker position identifying information acquired at Step S310. If it is determined at Step S340 that the worker is not present inside the movable range S0, that is, the worker is present outside the movable range S0, the process proceeds to Step S345. If it is determined at Step S340 that the worker is present inside the movable range S0, the process proceeds to Step S360.

At Step S350, the monitor control section 122 determines whether or not the worker is present inside the movable range S0 on the basis of the worker position identifying information acquired at Step S310. If it is determined at Step S350 that the worker is not present inside the movable range S0, that is, the worker is present outside the movable range S0, the process proceeds to Step S355. If it is determined at Step S350 that the worker is present inside the movable range S0, the process proceeds to Step S360.

At Step S345, the monitor control section 122 causes a presence informing icon 181 (see FIG. 15 and FIG. 16) representing that the worker is present outside the movable range S0 to be displayed on the display section 18*a* of the touch panel monitor 18.

At Step S355, the monitor control section 122 causes an approval request icon 182 (see FIG. 16) representing that the worker who is present outside the movable range S0 has made an approval request to be displayed on the display section 18*a* of the touch panel monitor 18. In addition, the monitor control section 122 causes a message for informing the operator that the worker has made the approval request to be displayed on the display section 18*a* of the touch panel monitor 18.

At Step S360, the monitor control section 122 causes a precautionary icon 184 (see FIG. 18) representing that the worker (hereinafter, written also as an unapproved worker) has not been approved to enter the movable range S0 is present inside the movable range S0 to be displayed on the display section 18*a* of the touch panel monitor 18. In addition, the monitor control section 122 causes an attention calling message for informing the operator that the unapproved worker is present inside the movable range S0 and that accordingly operation of the hydraulic excavator 1 is restricted to be displayed on the display section 18*a* of the touch panel monitor 18.

At Step S370, the monitor control section 122 causes an approval icon 183 (see FIG. 16 and FIG. 17) representing that the worker whose has been approved as a result of approval operation is present outside the work range S1 to be displayed on the display section 18*a* of the touch panel monitor 18.

At Step S380, the monitor control section 122 causes a warning icon 185 (see FIG. 17) representing that the worker is present inside the work range S1 to be displayed on the display section 18*a* of the touch panel monitor 18. In addition, the monitor control section 122 causes a warning message for informing the operator that the worker is present inside the work range S1 and that accordingly operation of the hydraulic excavator 1 is restricted to be displayed on the display section 18*a* of the touch panel monitor 18.

The process depicted in the flowchart in FIG. 10 is executed repeatedly at predetermined control intervals, thus if the worker position identifying information and the interpersonal communication level information changes, images to be displayed on the display section 18*a* of the touch panel monitor 18 changes. Accordingly, the operator of the hydraulic excavator 1 can appropriately grasp the current situation.

The operativity/inoperativity determining section 127 depicted in FIG. 4 determines whether or not the hydraulic excavator 1 is in an operative state on the basis of the operation position of the gate lock lever 60*a* of the gate lock lever device 60. Where the gate lock lever 60*a* has been operated to be at the unlock position, the operativity/inoperativity determining section 127 determines that the hydraulic excavator 1 is in an operative state, and turns on an operativity flag. Where the gate lock lever 60*a* has been operated to be at the lock position, the operativity/inoperativity determining section 127 determines that the hydraulic excavator 1 is not in an operative state, that is, the hydraulic excavator 1 is in an inoperative state, and turns off the operativity flag.

The notification control section 126 decides modes of notification by the external notification light 22 and the external notification buzzer 23 on the basis of the work mode set at the mode setting section 125, the result of the determination (operativity flag information) at the operativity/inoperativity determining section 127, and the worker position identifying information and interpersonal communication level. The notification control section 126 controls the external notification light 22 and the external notification buzzer 23 to thereby give notifications in the decided modes of notification by using the external notification light 22 and the external notification buzzer 23.

The notification control section 126 changes the modes of notification by the notification devices (22 and 23) when the worker position sensor has sensed that a worker for whom the interpersonal communication level equal to or lower than a reference level has been set has moved from the outside of the movable range S0 to the inside. Thereby, the worker can know that she/he has entered the movable range S0 unintentionally. In addition, the notification control section 126 changes the modes of notification by the notification devices (22 and 23) when the worker position sensor has sensed that a worker for whom the interpersonal communication level equal to or higher than the reference level has been set has moved from the outside of the work range S1 to the inside. Thereby, the worker can know that she/he has entered the work range S1 unintentionally. The reference level is a predetermined threshold, and is "2" in the present embodiment. In addition, the notification control section 126 decides the modes of notification by the notification devices (22 and 23) on the basis of a result of the determination whether or not the work range S1 of the hydraulic excavator 1 has been set (i.e. the state of setting about the work mode). The content of a process by the notification control section 126 is explained below in detail with reference to FIG. 11 to FIG. 13.

Figure 11:
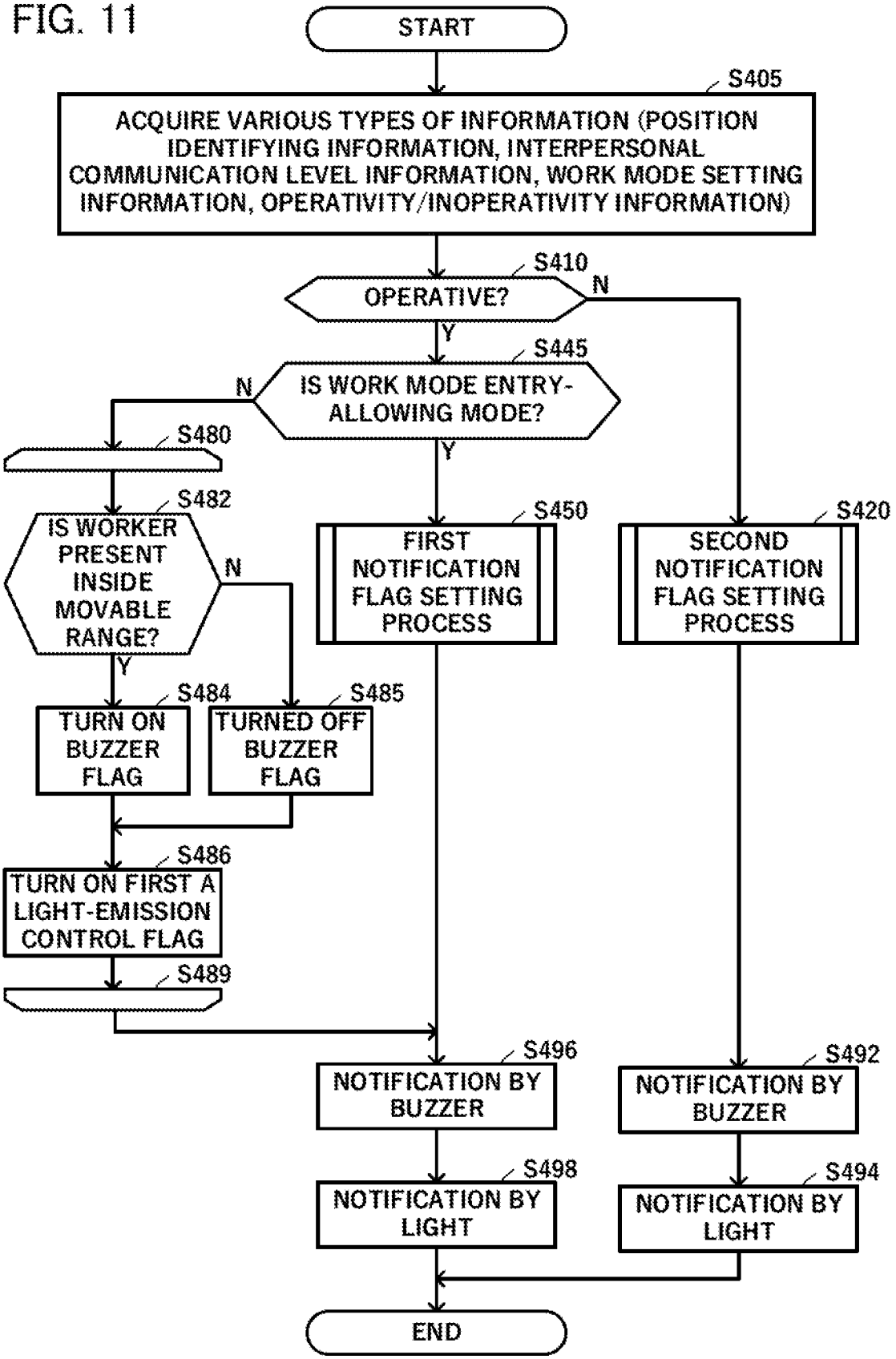
FIG. 11 is a flowchart depicting an external notification process executed by the controller.
Figure 12:
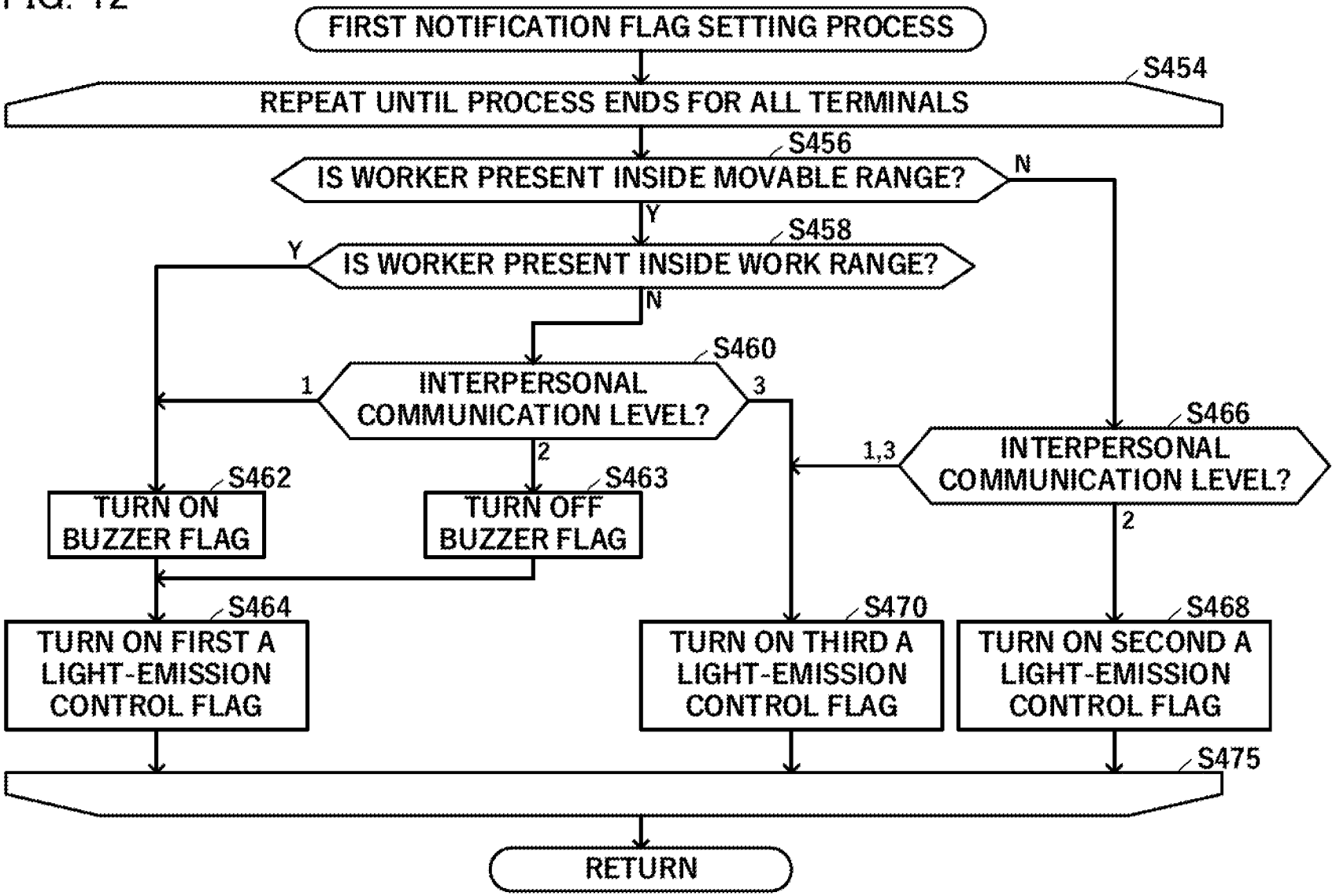
FIG. 12 is a flowchart depicting a first notification flag setting process in FIG. 11.
Figure 13:
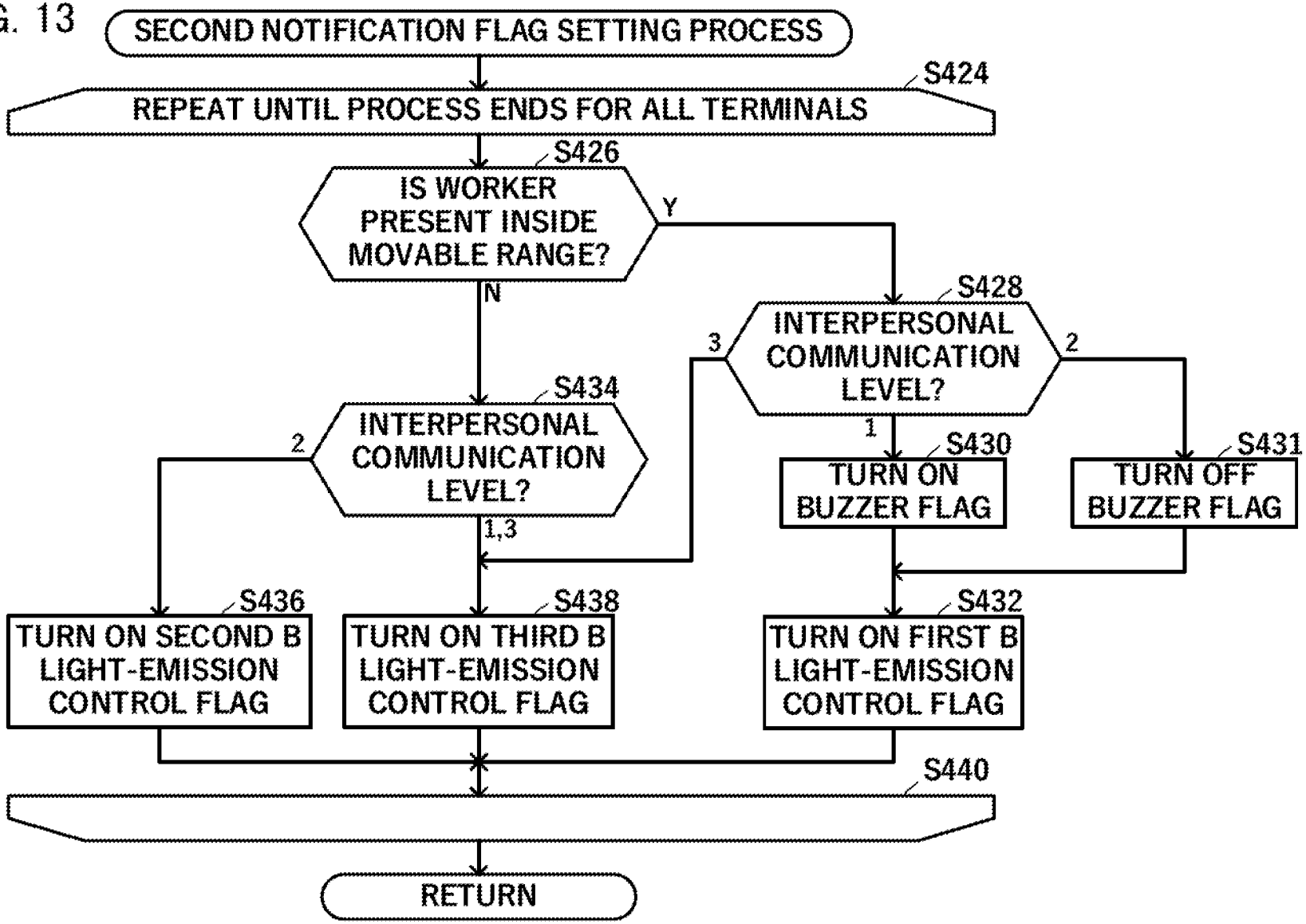
FIG. 13 is a flowchart depicting a second notification flag setting process in FIG. 11.

FIG. 11 is a flowchart depicting an external notification process executed by the controller (notification control section 126) 100. FIG. 12 is a flowchart depicting a first notification flag setting process in FIG. 11, and FIG. 13 is a flowchart depicting a second notification flag setting process in FIG. 11. For example, the process in the flowchart depicted in FIG. 11 is started when a mobile terminal 5 and the communication device 20 are connected to each other by wireless communication, and is executed repeatedly at predetermined control intervals.

As depicted in FIG. 11, at Step S405, the notification control section 126 acquires the worker position identifying information stored on the worker position table (see FIG. 7A). In addition, at Step S405, the notification control section 126 acquires the interpersonal communication level information stored on the interpersonal communication level table (see FIG. 7C). Furthermore, at Step S405, the notification control section 126 acquires work mode setting information and operativity/inoperativity information (operativity flag information). At Step S405, upon acquisition of various types of information, the notification control section 126 proceeds to Step S410.

At Step S410, the notification control section 126 determines whether or not the hydraulic excavator 1 is in an operative state on the basis of the operativity/inoperativity information acquired at Step S405. Where the operativity flag has been turned off, the notification control section 126 determines that the hydraulic excavator 1 is not in an operative state, that is, the hydraulic excavator 1 is in an inoperative state, and proceeds to Step S420. At Step S410, where the operativity flag has been turned on, the notification control section 126 determines that the hydraulic excavator 1 is in an operative state, and proceeds to Step S445.

At Step S445, the notification control section 126 determines whether or not the work mode has been set to the entry-allowing mode on the basis of the work mode information acquired at Step S405. If it is determined at Step S445 that the work mode has been set to the entry-allowing mode, the process proceeds to Step S450. If it is determined at Step S445 that the work mode has not been set to the entry-allowing mode, that is, the work mode has been set to the entry-prohibiting mode, the process proceeds to Step S480.

If it is determined at Step S445 depicted in FIG. 11 that the work mode has been set to the entry-allowing mode, the notification control section 126 executes a first notification flag setting process S450. As depicted in FIG. 12, the first notification flag setting process S450 is a loop process (Steps 454, S475) that is repeated until the light-emission control flag setting process is completed for all mobile terminals 5 connected by wireless communication.

At Step S456, the notification control section 126 determines whether or not the worker is present inside the movable range S0 on the basis of the worker position identifying information acquired at Step S405. If it is determined at Step S456 that the worker is present inside the movable range S0, the process proceeds to Step S458, and if it is determined that the worker is not present inside the movable range S0, that is, the worker is present outside the movable range S0, the process proceeds to Step S466.

At Step S458, the notification control section 126 determines whether or not the worker is present inside the work range S1 on the basis of the worker position identifying information acquired at Step S405. If it is determined at Step S458 that the worker is not present inside the work range S1, that is, the worker is present outside the work range S1, the process proceeds to Step S460, and if it is determined that the worker is present inside the work range S1, the process proceeds to Step S462.

At Step S460, the notification control section 126 determines which of "1," "2," and "3" the interpersonal communication level is on the basis of the interpersonal communication level information acquired at Step S405. If it is determined at Step S460 that the interpersonal communication level is "1," the process proceeds to Step S462. If it is determined at Step S460 that the interpersonal communication level is "2," the process proceeds to Step S463. If it is determined at Step S460 that the interpersonal communication level is "3," the process proceeds to Step S470.

At Step S466, the notification control section 126 determines which of "1," "2," and "3" the interpersonal communication level is on the basis of the interpersonal communication level information acquired at Step S405. If it is determined at Step S466 that the interpersonal communication level is "1" or "3," the process proceeds to Step S470. If it is determined at Step S466 that the interpersonal communication level is "2," the process proceeds to Step S468.

At Step S462, the notification control section 126 turns on a buzzer flag, and proceeds to Step S464. At Step S463, the notification control section 126 turns off the buzzer flag, and proceeds to Step S464. At Step S464, the notification control section 126 turns on a first A light-emission control flag, turns off other light-emission control flags, and proceeds to Step S475. At Step S468, the notification control section 126 turns on a second A light-emission control flag, turns off other light-emission control flags and the buzzer flag, and proceeds to Step S475. At Step S470, the notification control section 126 turns on a third A light-emission control flag, turns off other light-emission control flags and the buzzer flag, and proceeds to Step S475.

In this manner, the notification control section 126, when the hydraulic excavator 1 is in an operative state, and additionally the work mode has been set to the entry-allowing mode, turns on any of the first A light-emission control flag, the second A light-emission control flag, and the third A light-emission control flag in association with the terminal ID, and turns off other light-emission control flags. Upon completion of the first notification flag setting process (Step S450), the process proceeds to Step S496 depicted in FIG. 11.

If it is determined at Step S445 depicted in FIG. 11 that the work mode has not been set to the entry-allowing mode, that is, the work mode has been set to the entry-prohibiting mode, the notification control section 126 executes a loop process (Steps S480, S489). The loop process (Steps S480, S489) is repeated until the light-emission control flag setting process is completed for all mobile terminals 5 connected by wireless communication. A process to be executed in the loop process (Steps S480, S489) is explained below.

At Step S482, the notification control section 126 determines whether or not the worker is present inside the movable range S0 on the basis of the worker position identifying information acquired at Step S405. If it is determined at Step S482 that the worker is present inside the movable range S0, the process proceeds to Step S484, and if it is determined that the worker is not present inside the movable range S0, that is, the worker is present outside the movable range S0, the process proceeds to Step S485.

At Step S484, the notification control section 126 turns on the buzzer flag, and proceeds to Step S486. At Step S485, the notification control section 126 turns off the buzzer flag, and proceeds to Step S486. At Step S486, the notification control section 126 turns on the first A light-emission control flag, turns off other light-emission control flags, and proceeds to Step S489. Upon completion of the loop process (Steps S480, S489), the process proceeds to Step S496.

If it is determined at Step S410 that the hydraulic excavator 1 is not in an operative state, the notification control section 126 executes a second notification flag setting process S420. As depicted in FIG. 13, the second notification flag setting process S420 is a loop process (Steps S424, S440) that is repeated until the light-emission control flag setting process is completed for all mobile terminals 5 connected by wireless communication.

At Step S426, the notification control section 126 determines whether or not the worker is present inside the movable range S0 on the basis of the worker position identifying information acquired at Step S405. If it is determined at Step S426 that the worker is present inside the movable range S0, the process proceeds to Step S428, and if it is determined that the worker is not present inside the movable range S0, that is, the worker is present outside the movable range S0, the process proceeds to Step S434.

At Step S428, the notification control section 126 determines which of "1," "2," and "3" the interpersonal communication level is on the basis of the interpersonal communication level information acquired at Step S405. If it is determined at Step S428 that the interpersonal communication level is "1," the process proceeds to Step S430. If it is determined at Step S428 that the interpersonal communication level is "2," the process proceeds to Step S431. If it is determined at Step S428 that the interpersonal communication level is "3," the process proceeds to Step S438.

At Step S434, the notification control section 126 determines which of "1," "2," and "3" the interpersonal communication level is on the basis of the interpersonal communication level information acquired at Step S405. If it is determined at Step S434 that the interpersonal communication level is "1" or "3," the process proceeds to Step S438. If it is determined at Step S434 that the interpersonal communication level is "2," the process proceeds to Step S436.

At Step S430, the notification control section 126 turns on the buzzer flag, and proceeds to Step S432. At Step S431, the notification control section 126 turns off the buzzer flag, and proceeds to Step S432. At Step S432, the notification control section 126 turns on a first B light-emission control flag, turns off other light-emission control flags, and proceeds to Step S440. At Step S436, the notification control section 126 turns on a second B light-emission control flag, turns off other light-emission control flags and the buzzer flag, and proceeds to Step S440. At Step S438, the notification control section 126 turns on a third B light-emission control flag, turns off other light-emission control flags and the buzzer flag, and proceeds to Step S440.

In this manner, the notification control section 126, when the hydraulic excavator 1 is not in an operative state, turns on any of the first B light-emission control flag, the second B light-emission control flag, and the third B light-emission control flag in association with the terminal ID, and turns off other light-emission control flags. Upon completion of the second notification flag setting process (Step S420), the process proceeds to Step S492 depicted in FIG. 11.

At Step S492 in FIG. 11, the notification control section 126 controls the external notification buzzer 23 on the basis of buzzer flag setting information, and proceeds to Step S494. At Step S496, the notification control section 126 controls the external notification buzzer 23 on the basis of buzzer flag setting information, and proceeds to Step S498. At Steps S492 and S496, the notification control section 126 refers to setting information about the buzzer flag set for the terminal ID of each of all mobile terminals 5 connected by wireless communication. At Steps S492 and S496, where the buzzer flag associated with at least one terminal ID in the terminal IDs of all the mobile terminals 5 connected by wireless communication has been turned on, the notification control section 126 outputs sound by using the external notification buzzer 23. At Steps S492 and S496, where all buzzer flags associated with the terminal IDs of all the mobile terminals 5 connected by wireless communication have been turned off, the notification control section 126 does not output sound by using the external notification buzzer 23.

At Steps S494 and S498, the notification control section 126 controls the external notification light 22 on the basis of the light-emission control flag setting information, and ends the process depicted in the flowchart in FIG. 11. The notification control section 126 refers to setting information about the light-emission control flag set for the terminal ID of each of all the mobile terminals 5 connected by wireless communication.

At Steps S494 and S498, the notification control section 126 decides a mode of notification of the external notification light 22 on the basis of a priority of the light-emission control flag set for each terminal ID. The priority of the light-emission control flag is predetermined, and stored on the ROM 112. The priority of the first A light-emission control flag is higher than the priority of the second A light-emission control flag, and the priority of the second A light-emission control flag is higher than the priority of the third A light-emission control flag. The priority of the first B light-emission control flag is higher than the priority of the second B light-emission control flag, and the priority of the second B light-emission control flag is higher than the priority of the third B light-emission control flag.

At Step S498, the notification control section 126, when the light-emission control flag setting information associated with the terminal IDs of all the mobile terminals 5 connected by wireless communication includes information that the first A light-emission control flag has been turned on, controls the external notification light 22 such that the external notification light 22 gives a notification in a mode of notification of flashing a red LED (the red LED is caused to emit light intermittently). The mode of notification of flashing the red LED is a mode of notification for giving a warning prompting workers to move away from the hydraulic excavator 1.

At Step S498, the notification control section 126 controls the external notification light 22 such that the external notification light 22 gives a notification in a mode of notification of flashing a yellow LED, when the light-emission control flag setting information associated with the terminal IDs of all the mobile terminals 5 connected by wireless communication does not include information that the first A light-emission control flag has been turned on, but includes information that the second A light-emission control flag has been turned on. The mode of notification of flashing the yellow LED is a mode of notification for informing workers that approval has not been given, and also calling for attention of the workers informing that they are not allowed to enter the movable range S0 until approval is given.

At Step S498, the notification control section 126 controls the external notification light 22 such that the external notification light 22 gives a notification in a mode of notification of flashing a green LED, when the light-emission control flag setting information associated with the terminal IDs of all the mobile terminals 5 connected by wireless communication includes information that the third A light-emission control flag has been turned on.

At Step S494, the notification control section 126 controls the external notification light 22 such that the external notification light 22 gives a notification in a mode of notification of turning on the red LED (the red LED is caused to emit light continuously), when the light-emission control flag setting information associated with the terminal IDs of all the mobile terminals 5 connected by wireless communication includes information that the first B light-emission control flag has been turned on. The mode of notification of turning on the red LED is a mode of notification for giving a warning prompting workers to move away from the hydraulic excavator 1.

At Step S494, the notification control section 126 controls the external notification light 22 such that the external notification light 22 gives a notification in a mode of notification of turning on the yellow LED, when the light-emission control flag setting information associated with the terminal IDs of all the mobile terminals 5 connected by wireless communication does not include information that the first B light-emission control flag has been turned on, but includes information that the second B light-emission control flag has been turned on. The mode of notification of turning on the yellow LED is a mode of notification for informing workers that approval has not been given, and also calling for attention of the workers informing that they are not allowed to enter the movable range S0 until approval is given.

At Step S494, the notification control section 126 controls the external notification light 22 such that the external notification light 22 gives a notification in a mode of notification of turning on the green LED, when the light-emission control flag setting information associated with the terminal IDs of all the mobile terminals 5 connected by wireless communication includes information that the third B light-emission control flag has been turned on.

As mentioned above, the notification control section 126 selects modes of notification by the external notification light 22 and the external notification buzzer 23 according to conditions. The contents of the modes of notification are notified in advance to the workers. Note that the contents of the modes of notification may be able to be checked on mobile terminals 5. For example, it is notified in advance to the workers that the modes of notification of flashing and turning on the green LED are modes of notification representing either (1) a state where workers are not present inside the movable range, and additionally an approval request has not been made by the workers or (2) a state where approval has been given to an approval request from a worker.

The operation-amount computing section 128 in FIG. 4 computes an operation amount on the basis of a signal output from the operation sensor 34*b* of the operation device 34. On the basis of the operation amount computed at the operation-amount computing section 128, the valve control section (actuator control section) 129 controls the solenoid proportional valve 33 to thereby control operation of each actuator. Specifically, on the basis of the operation amount, the valve control section 129 computes a target speed of an actuator, and computes a command value of a control current to be supplied to the solenoid proportional valve 33 such that the actuator operates at the target speed. The valve control section 129 controls the control current such that the control current to be supplied to the solenoid proportional valve 33 matches the command value. The larger the control current is, the larger the command pilot pressure generated by the solenoid proportional valve 33 is.

The valve control section 129 performs restriction control of operation of the work implement 10, swing operation of the swing structure 3, and travel operation of the travel structure 2 on the basis of interpersonal communication levels and worker position identifying information. The restriction control includes deceleration control of decelerating operation of actuators, and stop control of stopping operation of actuators. In the deceleration control, the valve control section 129 corrects a target speed of an actuator computed on the basis of an operation amount, by multiplying the target speed by a predetermined correction coefficient (a value greater than 0 and smaller than 1). Note that instead of this correction method, a method in which an upper limit value is determined in advance, and a target speed computed on the basis of an operation amount is corrected to the upper limit value when the target speed is greater than the upper limit value may be adopted. In the stop control, the valve control section 129 sets the command value of the control current to "0." Note that in a state in which an actuator is operating, the command value of the control current is preferably changed such that the command value gradually decreases to "0."

The valve control section 129 executes restriction control of restricting operation of the boom cylinder 11*a*, the arm cylinder 12*a*, the bucket cylinder 13*a*, the travel motors 2*a*, and the swing motor 3*a* when the worker position sensor has sensed the presence, in the movable range S0, of a worker for whom the interpersonal communication level equal to or lower than the reference level "2" is set. The valve control section 129 executes any of normal control, deceleration control, and stop control on the basis of operation control flag setting information. The valve control section 129, when the hydraulic excavator 1 is in an operative state, turns on any of a normal control flag, a deceleration control flag, and a stop control flag. Note that these operation control flags are set for each worker (for each mobile terminal 5).

The valve control section 129, when a worker is present inside the work range S1, turns on the stop control flag irrespective of the interpersonal communication level, and turns off other operation control flags (the normal control flag and the deceleration control flag). The valve control section 129, when a worker is present inside the movable range S0, and the interpersonal communication level of the worker is equal to or lower than the reference level "2," turns on the deceleration control flag, and turns off other operation control flags (the normal control flag and the stop control flag). In cases other than those described above, the valve control section 129 turns on the normal control flag, and turns off other operation control flags (the deceleration control flag and the stop control flag).

Figure 14:
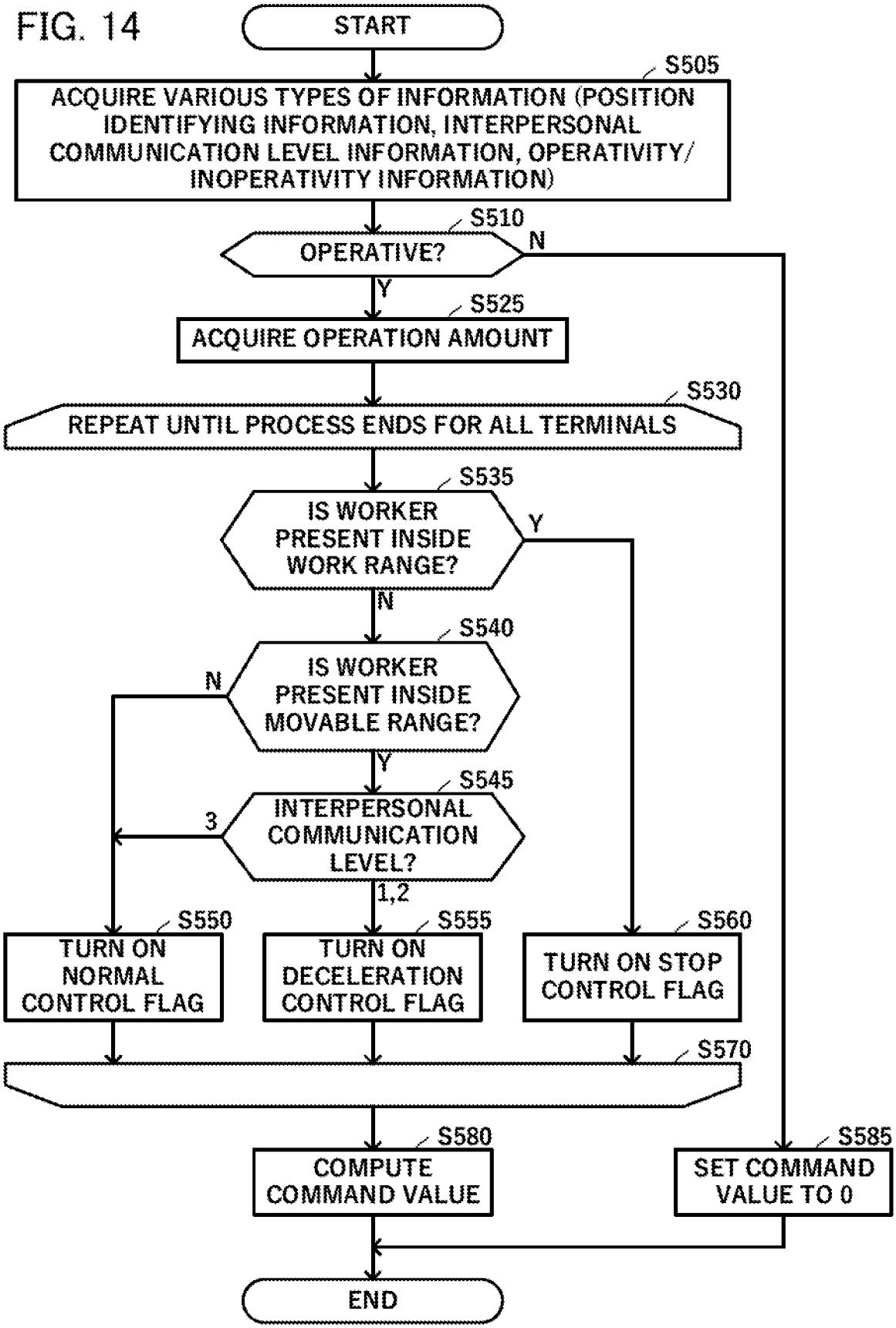
FIG. 14 is a flowchart depicting an operation control flag setting process executed by the controller.

FIG. 14 is a flowchart depicting an operation control flag setting process executed by the controller (valve control section 129) 100. For example, the process in the flowchart depicted in FIG. 14 is started when an ignition switch is turned on, and is executed repeatedly at predetermined control intervals.

As depicted in FIG. 14, at Step S505, the valve control section 129 acquires the worker position identifying information stored on the worker position table (see FIG. 7A), the interpersonal communication level information stored on the interpersonal communication level table (see FIG. 7C) and the operativity/inoperativity information (operativity flag information), and proceeds to Step S510.

At Step S510, the valve control section 129 determines whether or not the hydraulic excavator 1 is in an operative state on the basis of the operativity/inoperativity information acquired at Step S505. Where the operativity flag has been turned off, the valve control section 129 determines that the hydraulic excavator 1 is not in an operative state, that is, the hydraulic excavator 1 is in an inoperative state, and proceeds to Step S585. At Step S510, where the operativity flag has been turned on, the valve control section 129 determines that the hydraulic excavator 1 is in an operative state, and proceeds to Step S525.

At Step S525, the valve control section 129 acquires an operation amount of the operation device 34 computed at the operation-amount computing section 128. Upon acquisition of the operation amount at Step S525, the valve control section 129 executes a loop process (Steps S530, S570).

The loop process (Steps S530, S570) ends when the process on all the mobile terminals 5 connected by wireless communication is completed, and when the loop process ends, the process proceeds to Step S580. A process to be executed in the loop process (Steps S530, S570) is explained below.

At Step S535, the valve control section 129 determines whether or not the worker is present inside the work range S1 on the basis of the worker position identifying information acquired at Step S505. If it is determined at Step S535 that the worker is not present inside the work range S1, that is, the worker is present outside the work range S1, the process proceeds to Step S540, and if it is determined that the worker is present inside the work range S1, the process proceeds to Step S560.

At Step S540, the valve control section 129 determines whether or not the worker is present inside the movable range S0 on the basis of the worker position identifying information acquired at Step S505. If it is determined at Step S540 that the worker is present inside the movable range S0, the process proceeds to Step S545, and if it is determined that the worker is not present inside the movable range S0, that is, the worker is present outside the movable range S0, the process proceeds to Step S550.

At Step S545, the valve control section 129 determines which of "1," "2," and "3" the interpersonal communication level is on the basis of the interpersonal communication level information acquired at Step S505. If it is determined at Step S545 that the interpersonal communication level is "1" or "2," the process proceeds to Step S555. If it is determined at Step S545 that the interpersonal communication level is "3," the process proceeds to Step S550.

At Step S550, the valve control section 129 turns on the normal control flag, turns off other operation control flags, and proceeds to Step S570. At Step S555, the valve control section 129 turns on the deceleration control flag, turns off other operation control flags, and proceeds to Step S580. At Step S560, the valve control section 129 turns on the stop control flag, turns off other operation control flags, and proceeds to Step S570. Upon completion of the loop process (Steps S530, S570), the process proceeds to Step S580.

At Step S580, the valve control section 129 controls the solenoid proportional valve 33 on the basis of the operation control flag setting information, and ends the process depicted in the flowchart in FIG. 14. The valve control section 129 refers to setting information about the operation control flag set for the terminal ID of each of all the mobile terminals 5 connected by wireless communication.

At Step S580, the valve control section 129 decides an operation mode on the basis of a priority of the operation control flag set for each terminal ID. The priority of the operation control flag is predetermined, and stored on the ROM 112. The priority of the stop control flag is higher than the priority of the deceleration control flag, and the priority of the deceleration control flag is higher than the priority of the normal control flag.

At Step S580, the valve control section 129 executes stop control when the operation control flag setting information associated with the terminal IDs of all the mobile terminals 5 connected by wireless communication includes information that the stop control flag has been turned on. Thereby, even where operation is performed by using the operation device 34, the flow rate control valve 40 is kept at the neutral position (N), thus operation of the actuator is prevented. In addition, if the stop control is executed in a state where operation is being performed by using the operation device 34, and the actuator is operating, the flow rate control valve 40 is switched to the neutral position (N), thus the operation of the actuator is stopped.

At Step S580, the valve control section 129 executes deceleration control when the operation control flag setting information associated with the terminal IDs of all the mobile terminals 5 connected by wireless communication does not include information that the stop control flag has been turned on, but includes information that the deceleration control flag has been turned on. Thereby, the actuator operates at a speed lower than the speed of the actuator according to an operation amount of the operation device 34.

At Step S580, the valve control section 129 executes normal control when the operation control flag setting information associated with the terminal IDs of all the mobile terminals 5 connected by wireless communication includes information that the normal control flag has been turned on. In the normal control performed at Step S580, the valve control section 129 computes a command value on the basis of an operation amount. Thereby, the actuator operates at the speed according to the operation amount of the operation device 34.

At Step S585, the valve control section 129 sets the command value of the solenoid proportional valve 33 to "0," and ends the process depicted in the flowchart in FIG. 14.

Figure 15:
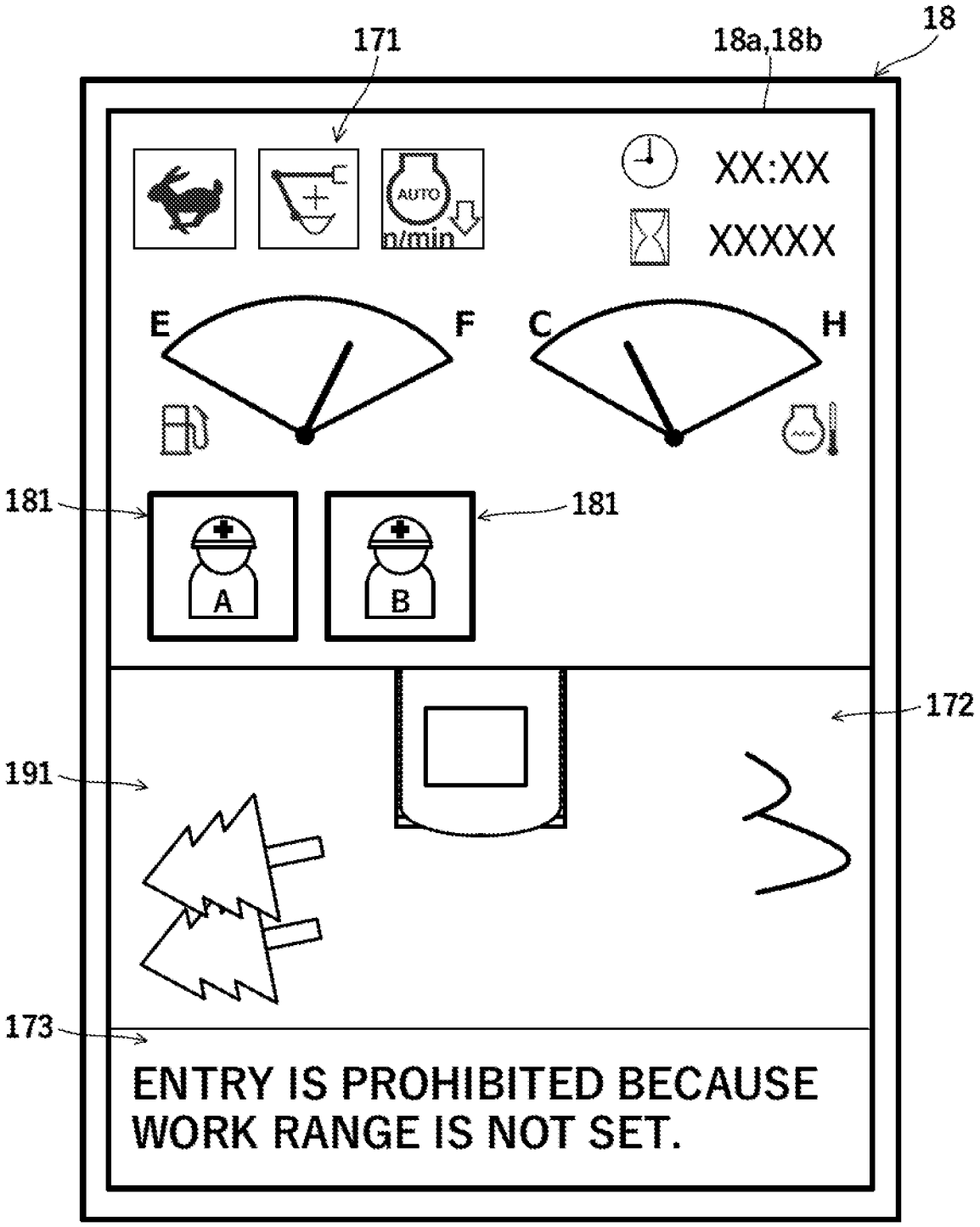
FIG. 15 is a figure depicting a screen of the touch panel monitor, and depicts a screen displayed when a work mode has been set to an entry-prohibiting mode.

Next, an operation example of the hydraulic excavator 1 according to the present embodiment is explained. FIG. 15 is a figure depicting a screen of the touch panel monitor 18, and depicts a screen displayed when the work mode has been set to the entry-prohibiting mode. Note that FIG. 15 depicts also modes of notification of the external notification light 22 and the external notification buzzer 23.

As depicted in FIG. 15, the screen of the touch panel monitor 18 includes: an activation information display area 171 that displays activation information such as activation time, the remaining fuel amount meter, and the coolant thermometer of the hydraulic excavator 1; a surrounding environment monitoring area 172 that displays the bird's-eye view image 191 generated from images captured by cameras of the surrounding environment monitoring device 55; and a message area 173 that displays messages.

The operator operates the gate lock lever 60*a* such that the gate lock lever 60*a* is at its unlock position (lowered position), and operates the ignition switch to start the engine 80, and thereby operation of each actuator by the operation device 34 is enabled. Where a worker is present around the hydraulic excavator 1, the touch panel monitor 18 displays the presence informing icon 181 (S325→S330→S340→S345 in FIG. 10). Because of this, the operator of the hydraulic excavator 1 can know that the worker is present around the hydraulic excavator 1. For example, the presence informing icon 181 is an icon with a white background on which an illustration of the worker and a character of the worker's name ("A" and "B" in the present embodiment) are provided. The worker's name is associated with the terminal ID, and is stored on the ROM 112 in advance. Note that the worker's name may be acquired from the mobile terminal 5.

Where the operator has not set the work range S1, the work mode is set to the entry-prohibiting mode. In a state where the entry-prohibiting mode has been set, the red LED of the external notification light 22 flashes. That is, the worker around the hydraulic excavator 1 is notified that the work range S1 has not been set (S410→S445→S480→S482→S485→S486→S489→S496→S498 in FIG. 11). In the example depicted in FIG. 15, a worker A and a worker B are positioned outside the movable range S0, thus a notification by the external notification buzzer 23 is not given. If either the worker A or the worker B moves to the inside of the movable range S0, a notification by the external notification buzzer 23 is given (S482→S484 in FIG. 11).

Where the operator has not set the work range S1, there is a possibility that the hydraulic excavator 1 operates over the entire area of the movable range S0 of the hydraulic excavator 1. In the present embodiment, flashing of the red LED of the external notification light 22 can notify workers around the hydraulic excavator 1 that the work range S1 has not been set, thus entry of the workers into the movable range S0 can be prevented. In addition, in this state, a worker can know in advance that even if the worker makes an approval request by operating the mobile terminal 5, the operator is not in a situation to give approval. Accordingly, it is possible to prevent approval request operation by workers from being performed unnecessarily undesirably. As a result, it is possible to attempt to enhance the work efficiency of the workers.

In a state in which the entry-prohibiting mode has been set, a message, "ENTRY IS PROHIBITED BECAUSE WORK RANGE IS NOT SET" is displayed in the message area 173 of the touch panel monitor 18. Thereby, the operator can know that the current work mode has been set to the entry-prohibiting mode.

Figure 16:
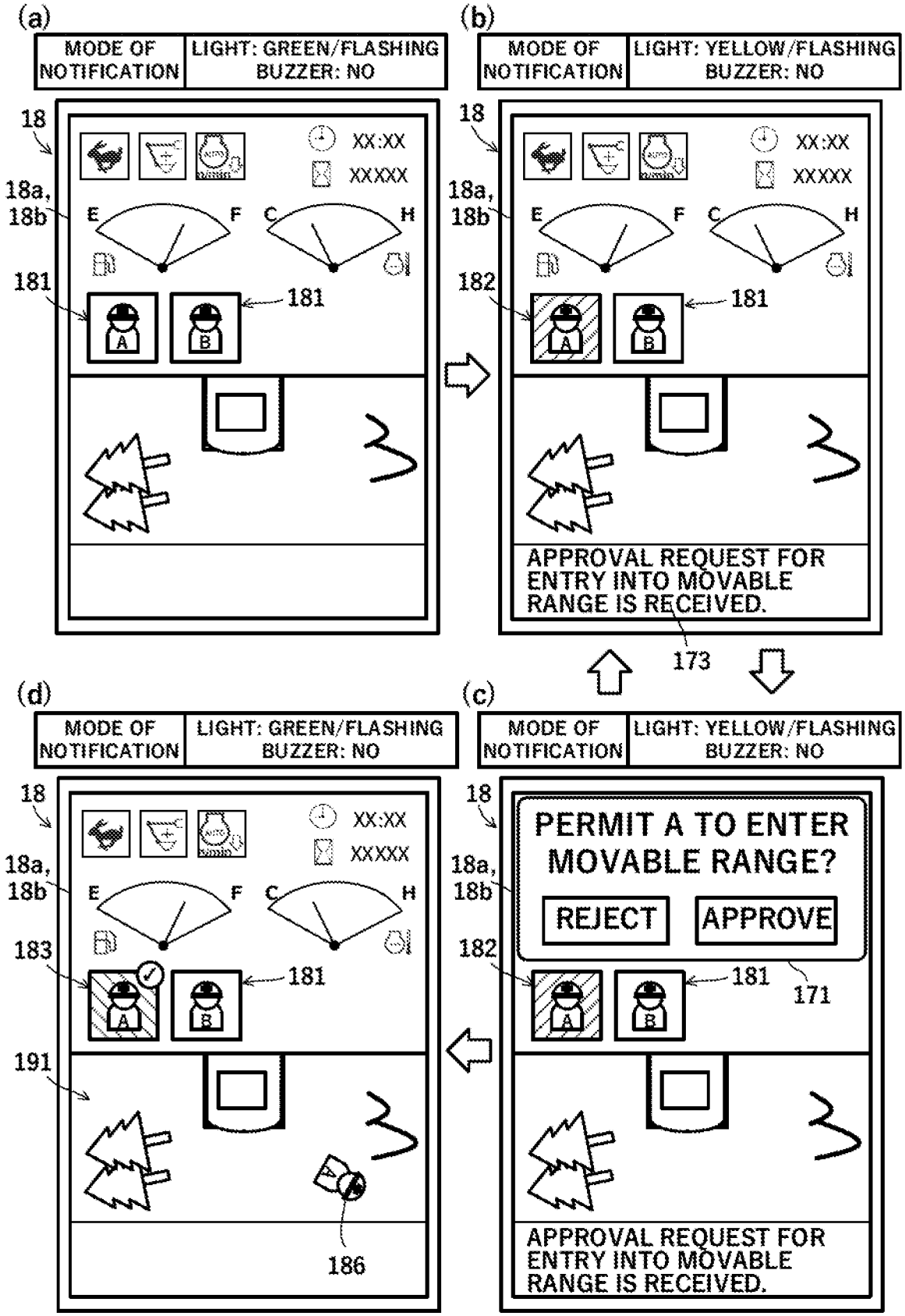
FIG. 16 is a figure for explaining screen transitions of the touch panel monitor, and depicts screen transitions from when a worker makes an approval request until when approval is given.
Figure 17:
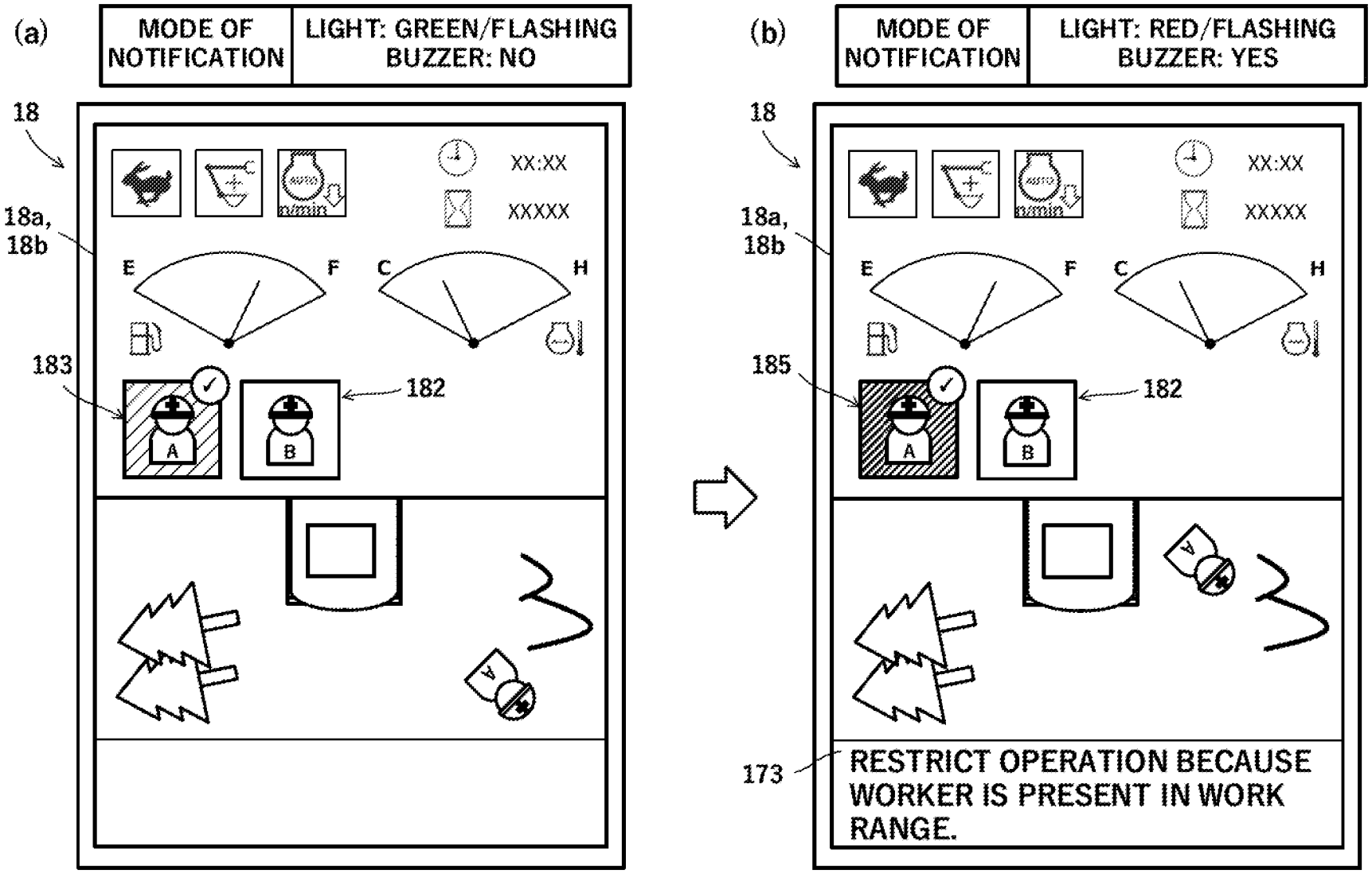
FIG. 17 is a figure for explaining a screen transition of the touch panel monitor, and depicts a screen transition when a worker has entered a work range.
Figure 18:
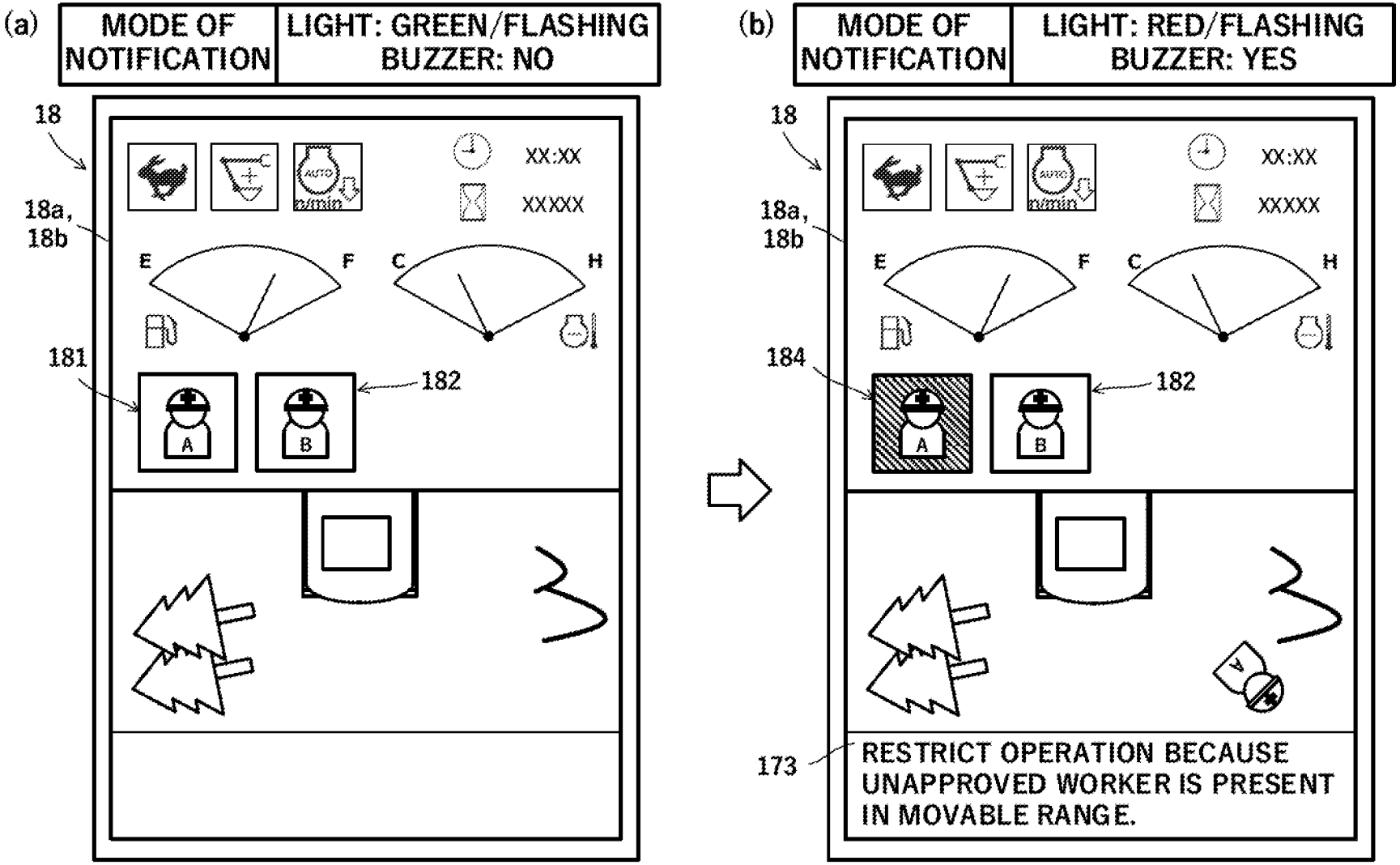
FIG. 18 is a figure for explaining a screen transition of the touch panel monitor, and depicts a screen transition when a worker has entered a movable range without making an approval request.

When the operator sets the work range S1 by operating the touch panel monitor 18 on the work range setting screen (see FIG. 6), the work mode is set to the entry-allowing mode. With reference to FIG. 16 to FIG. 18, a display mode of the touch panel monitor 18 in a state where the work mode has been set to the entry-allowing mode, and modes of notification by the external notification light 22 and the external notification buzzer 23 are explained.

FIG. 16 is a figure for explaining screen transitions of the touch panel monitor 18, and depicts screen transitions from when a worker makes an approval request until when approval is given. In addition, modes of notification of the external notification light 22 and the external notification buzzer 23 in the states depicted in (a) to (d) in FIG. 16 are also depicted.

Where an approval request for entry into the movable range S0 has been made from none of the worker A and the worker B, the interpersonal communication levels of both the worker A and the worker B are set to "1." Note that the worker A and the worker B are positioned outside the movable range S0. In this case, as depicted in (a) in FIG. 16, the presence informing icon 181 is displayed for each worker on the display screen of the touch panel monitor 18 (S325→S330→S340→S345 in FIG. 10).

Note that the worker A and the worker B are positioned outside the movable range S0, thus the mode of notification of the external notification light 22 is a mode of notification of flashing the green LED (S456→S466→S470 in FIG. 12). Note that a notification by the external notification buzzer 23 is not given. Accordingly, the worker A and the worker B can know that they are in situations where they can make approval requests.

If the worker A makes an approval request for entry into the movable range S0 by operating the mobile terminal 5, the interpersonal communication level of the worker A is set to "2." Thereby, as depicted in (b) in FIG. 16, the presence informing icon 181 of the worker A on the touch panel monitor 18 of the hydraulic excavator 1 changes to the approval request icon 182 (S325→S330→S350→S355 in FIG. 10). For example, the approval request icon 182 is an icon with a blue background on which an illustration of the worker and a character of the worker's name are provided. In addition, a message, "APPROVAL REQUEST FOR ENTRY INTO MOVABLE RANGE IS RECEIVED," is displayed in the message area 173 on the touch panel monitor 18. Accordingly, the operator can know that an approval request has been made by the worker A.

In the state depicted in (b) in FIG. 16, approval operation by the operator for the approval request from the worker A has not been performed, and the interpersonal communication level is set to "2." Because of this, the mode of notification of the external notification light 22 is the mode of notification of flashing the yellow LED (S456→S466→S468 in FIG. 12). Note that a notification by the external notification buzzer 23 is not given. Accordingly, the worker A can know that approval operation by the operator has not been performed (approval is being waited for).

The operator looks around the hydraulic excavator 1, and checks the position of the worker A. Taking the position of the worker A, the work content, the state of the hydraulic excavator 1, and the like into consideration, the operator judges whether to or not to permit entry of the worker A into the movable range S0. The operator performs approval operation when she/he permits entry of the worker A into the movable range S0.

Approval operation by the operator is explained. When the operator touches the approval request icon 182 on the touch panel monitor 18, as depicted in (c) in FIG. 16, a message "PERMIT A TO ENTER MOVABLE RANGE?," a button "APPROVE" for deciding to permit entry into the movable range S0 and a button "REJECT" for deciding to not permit entry into the movable range S0 are displayed in the activation information display area 171. If the operator touches the button "APPROVE," as depicted in (d) in FIG. 16, the approval request icon 182 on the touch panel monitor 18 changes to the approval icon 183 (S325→S330→S370 in FIG. 10). For example, the approval icon 183 is an icon with a green background on which an illustration of the worker and a character of the worker's name are provided. In this manner, the approval operation in the present embodiment is equivalent to operation of touching the approval request icon 182, and touching the button "APPROVE."

In the state depicted in (d) in FIG. 16, approval operation by the operator for an approval request from the worker A has been performed, and the interpersonal communication level is set to "3." Because of this, the mode of notification of the external notification light 22 is the mode of notification of flashing the green LED (S456→S466→S470 in FIG. 12). Note that a notification by the external notification buzzer 23 is not given. The mode of notification of the external notification light 22 changes from flashing of the yellow LED to flashing of the green LED, thus the worker A can know that approval operation has been performed by the operator, that is, she/he is permitted to enter the movable range S0. In this manner, the worker A and the operator perform interpersonal communication regarding entry of the worker A into the movable range S0, thus work by the hydraulic excavator 1 and work by the worker A around the hydraulic excavator 1 can be performed efficiently.

Note that where the operator does not perform approval operation, the mode of notification of the external notification light 22 remains the mode of notification of flashing the yellow LED. In this case, the worker A can recognize that entry into the movable range S0 is rejected.

Where the worker A has entered the movable range S0 after approval operation is performed, operation of the hydraulic excavator 1 is not restricted, and each actuator can be operated according to operation by the operator. Note that the mode of notification of the external notification light 22 remains the mode of notification of flashing the green LED (S456→S458→S460→S470 in FIG. 12). In addition, a warning or the like is also not displayed on the touch panel monitor 18. The operator can perform work efficiently while checking the positional relation between the hydraulic excavator 1 and an image 186 of the worker A on the bird's-eye view image 191.

With reference to FIG. 17, changes in modes of informing the operator, and modes of notifying workers when a worker has entered the work range S1 are explained. FIG. 17 is a figure for explaining a screen transition of the touch panel monitor 18, and depicts a screen transition when a worker has entered the work range S1. In addition, modes of notification of the external notification light 22 and the external notification buzzer 23 in the states depicted in (a) in FIG. 17 and (b) in FIG. 17 are also depicted.

The state depicted in (a) in FIG. 17 is the same as the state depicted in (d) in FIG. 16. That is, in the state depicted in (a) in FIG. 17, approval operation by the operator for an approval request from the worker A has been performed, and the interpersonal communication level is set to "3." If the worker A enters the work range S1 in this state, the mode of notification of the external notification light 22 changes from flashing of the green LED to flashing of the red LED, and furthermore a notification by the external notification buzzer 23 is given (S456→S458→S462→S464 in FIG. 12).

Because the mode of notification of the external notification light 22 becomes flashing of the red LED, the worker A can know that she/he has entered the work range S1 of the hydraulic excavator 1 unintentionally, and can immediately evacuate to the outside of the work range S1. Note that even in a case where the worker A does not recognize that the external notification light 22 is flashing in red as in a case where she/he is not looking at the direction of the hydraulic excavator 1 or in other cases, a notification by the external notification buzzer 23 is given, thus it is possible to call for attention of the worker A to the hydraulic excavator 1.

Note that in the state depicted in (b) in FIG. 17, that is, in a state where the worker position sensor has sensed that a worker is present inside the work range S1, stop control is executed by the controller 100 irrespective of the interpersonal communication level such that actuators are not operated (S535→S560 in FIG. 14).

In this manner, where a worker has entered the work range S1, a notification for calling for attention of the worker is given even if she/he is an approved worker, and also operation of the hydraulic excavator 1 is restricted. Accordingly, it becomes possible to cause the worker to evacuate promptly while preventing contact of the worker with the hydraulic excavator 1.

If the worker A enters the work range S1 from the outside of the work range S1, the approval icon 183 of the worker A on the touch panel monitor 18 changes to the warning icon 185 (S325→S380 in FIG. 10). For example, the warning icon 185 is an icon with a red background on which an illustration of the worker and a character of the worker's name are provided. In addition, a message "RESTRICT OPERATION BECAUSE WORKER IS PRESENT IN WORK RANGE" is displayed in the message area 173 on the touch panel monitor 18. Accordingly, the operator can know that the worker A has entered the work range S1.

With reference to FIG. 18, changes in modes of informing the operator, and modes of notifying workers when the worker A who is not permitted to enter the movable range S0 has entered the movable range S0 from the outside of the movable range S0 are explained. FIG. 18 is a figure for explaining a screen transition of the touch panel monitor 18, and depicts a screen transition when a worker has entered the movable range S0 without making an approval request. In addition, modes of notification of the external notification light 22 and the external notification buzzer 23 in the states depicted in (a) in FIG. 18 and (b) in FIG. 18 are also depicted.

The state depicted in (a) in FIG. 18 is the same as the state depicted in (a) in FIG. 16. That is, in the state depicted in (a) in FIG. 18, none of the worker A and the worker B have not made approval requests for entry into the movable range S0. Because of this, the interpersonal communication levels between the workers A and B and the operator are set to "1." If the worker A enters the movable range S0 without making an approval request in this state, the mode of notification of the external notification light 22 changes from flashing of the green LED to flashing of the red LED, and furthermore a notification by the external notification buzzer 23 is given (S456→S458→S460→S462→S464 in FIG. 12).

Because the mode of notification of the external notification light 22 becomes flashing of the red LED, the worker A can know that she/he has entered the movable range S0 of the hydraulic excavator 1 unintentionally. Note that even in a case where the worker A does not recognize that the external notification light 22 is flashing in red as in a case where she/he is not looking at the direction of the hydraulic excavator 1 or in other cases, a notification by the external notification buzzer 23 is given, thus it is possible to call for attention of the worker A to the hydraulic excavator 1.

Note that where the worker A enters the movable range S0 after the worker A has made an approval request and before approval operation by the operator is performed, the mode of notification of the external notification light 22 changes from flashing of the yellow LED to flashing of the red LED (S456→S458→S460→S463→S464 in FIG. 12). Because the mode of notification of the external notification light 22 becomes flashing of the red LED, the worker A can know that she/he has entered the movable range S0 of the hydraulic excavator 1 unintentionally.

In addition, if the worker A who has not been approved (permitted) to enter the movable range S0 enters the movable range S0 from the outside of the movable range S0, deceleration control of operating actuators at speeds lower than target speeds according to the operation amount of the operation device 34 is executed (S535→S540→S545→S555 in FIG. 14). Because the actuators operate at speeds lower than speeds intended by the operator, a sense of discomfort about operation can be given to the operator.

If the worker A who has not been approved (permitted) to enter the movable range S0 enters the movable range S0 from the outside of the movable range S0, the presence informing icon 181 of the worker A on the touch panel monitor 18 changes to the precautionary icon 184 (S330→S340→S360 in FIG. 10 or S330→S350→S360 in FIG. 10). For example, the precautionary icon 184 is an icon with a yellow background on which an illustration of the worker and a character of the worker's name are provided. In addition, a message "RESTRICT OPERATION BECAUSE UNAPPROVED WORKER IS PRESENT IN MOVABLE RANGE" is displayed in the message area 173 on the touch panel monitor 18.

As a result, the operator can immediately know that the worker A who has not been approved (permitted) to enter the movable range S0 has entered the movable range S0. Note that in the state depicted in (b) in FIG. 18, operation of the hydraulic excavator 1 is restricted, thus the work efficiency of the hydraulic excavator 1 lowers when work is performed in this state. Accordingly, an advantage of prompting the operator to take action to ask the worker to evacuate can be expected. That is, according to the present embodiment, it is possible to attempt to correct the situation at a work site.

According to the embodiment mentioned above, the following effects and advantages are attained.

(1) The hydraulic excavator (work machine) 1 includes: the machine body 4; the work implement 10 attached to the machine body 4; the operation device 34 that is provided in the operation room 7, and gives an instruction about operation of the work implement 10 according to operation by an operator; the informing device (display section 18*a* of the touch panel monitor 18) that informs the operator; the input device (the input section 18*b* on the touch panel monitor 18) for inputting predetermined information; the notification device (the external notification light 22 and the external notification buzzer 23) that gives a notification to a worker around; the controller (controller) 100 that controls the touch panel monitor 18 and the notification device (the external notification light 22 and the external notification buzzer 23); and the communication device 20 that performs wireless communication with a mobile terminal 5 carried by the worker.

The controller 100 determines whether or not the communication device 20 has received an approval request for requesting approval of entry into the movable range S0 of the hydraulic excavator 1 transmitted from the mobile terminal 5 when the worker around the hydraulic excavator 1 operates the mobile terminal 5. The controller 100 informs, by using the touch panel monitor (informing device) 18, that the approval request has been received when it is determined that the communication device 20 has received the approval request. The controller 100 determines whether or not approval operation of approving entry into the movable range S0 of the hydraulic excavator 1 has been performed on the touch panel monitor 18. The controller 100 sets, for the worker, an interpersonal communication level representing (index) the degree of interpersonal communication between the operator and the worker depending on whether or not the approval request has been received and whether or not the approval operation has been performed. That is, an interpersonal communication level is set for each of a plurality of workers. The controller 100 decides a mode of notification by the notification device (the external notification light 22 and the external notification buzzer 23) in accordance with the interpersonal communication level. The controller 100 gives a notification in the decided mode of notification by using the notification device (the external notification light 22 and the external notification buzzer 23).

According to this configuration, the worker can appropriately interpersonally communicate with the operator of the hydraulic excavator 1 when entering the movable range S0 of the hydraulic excavator 1. For example, the worker can promptly judge whether or not it is possible to enter the movable range S0 by checking the mode of notification of the hydraulic excavator 1. In the present embodiment, where the yellow LED of the external notification light 22 is emitting light, the worker can intuitively recognize that she/he is not allowed to enter the movable range S0 until approval is given. Then, when approval is given, the mode of notification of the external notification light 22 changes from light-emission of the yellow LED to light-emission of the green LED, thus the worker can intuitively recognize that the worker is allowed to enter the movable range S0 in the current state. In addition, where a plurality of workers are present around the hydraulic excavator 1, each of the workers separately makes an approval request, and approval is given to each approval request. Because of this, each worker can judge whether or not her/his presence is perceived by the operator. Thereby, work by the hydraulic excavator 1 and smooth collaborative work between the hydraulic excavator 1 and the workers can be realized. That is, it is possible to attempt to enhance the efficiency of the work by the hydraulic excavator 1 and the work of the workers. In this manner, the present embodiment can provide the hydraulic excavator 1 that allows appropriate interpersonal communication between workers and the operator of the hydraulic excavator 1 when workers enter the movable range of the hydraulic excavator 1, and makes it possible to attempt to enhance the work efficiency.

(2) The hydraulic excavator 1 includes the worker position sensor (the GNSS receiving device 50, the communication device 20, and the controller 100) that senses a position of the worker around the hydraulic excavator 1. The controller 100 determines whether or not the worker is present in the predetermined movable range S0 of the hydraulic excavator 1 on the basis of the position of the worker around the hydraulic excavator 1 sensed by the worker position sensor, and decides the mode of notification by the notification device (the external notification light 22 and the external notification buzzer 23) on the basis of a result of the determination and the interpersonal communication level.

The controller 100 changes the mode of notification by the notification device when the worker position sensor has sensed that a worker for whom the interpersonal communication level equal to or lower than the predetermined reference level "2" is set has moved from the outside of the movable range S0 of the hydraulic excavator 1 to the inside of the movable range S0.

In the present embodiment, when a worker for whom the interpersonal communication level is set to "1" moves from the outside of the movable range S0 to the inside of the movable range S0, the mode of notification of the external notification light 22 changes from light-emission of the green LED to light-emission of the red LED. In addition, the mode of notification of the external notification buzzer 23 changes from "not give sound notification" to "give sound notification." Thereby, workers can intuitively recognize that they need to immediately move away from the hydraulic excavator 1.

In addition, in the present embodiment, when a worker for whom the interpersonal communication level is set to "2" moves from the outside of the movable range S0 to the inside of the movable range S0, the mode of notification of the external notification light 22 changes from light-emission of the yellow LED to light-emission of the red LED. Thereby, workers can intuitively recognize that they need to immediately move away from the hydraulic excavator 1.

In this manner, where a worker whose interpersonal communication level is equal to or lower than the reference level "2" (i.e. a worker who is not permitted to enter the movable range S0) has entered the movable range S0, the mode of notification changes, thus it is possible to appropriately prompt the worker to evacuate from the inside of the movable range S0 to the outside of the movable range S0.

(3) The hydraulic excavator 1 includes the touch panel monitor (work range setting device) 18 on which the work range S1 of the hydraulic excavator 1 is set. The controller 100 determines whether or not the worker is present inside the work range S1 of the hydraulic excavator 1 set on the touch panel monitor (work range setting device) 18 on the basis of the position of the worker around the hydraulic excavator 1 sensed by the worker position sensor, and decides the mode of notification by the notification device (the external notification light 22 and the external notification buzzer 23) on the basis of a result of the determination.

The controller 100 changes the mode of notification by the notification device when the worker position sensor has sensed that a worker for whom the interpersonal communication level equal to or higher than the predetermined reference level "2" is set has moved from the outside of the work range S1 to the inside of the work range S1.

In the present embodiment, when a worker for whom the interpersonal communication level is set to "2" moves from the outside of the work range S1 to the inside of the work range S1, the mode of notification of the external notification buzzer 23 changes from "not give sound notification" to "give sound notification." Thereby, workers can intuitively recognize that they need to immediately move away from the hydraulic excavator 1.

In addition, in the present embodiment, when a worker for whom the interpersonal communication level is set to "3" moves from the outside of the work range S1 to the inside of the work range S1, the mode of notification of the external notification light 22 changes from flashing of the green LED to flashing of the red LED. In addition, the mode of notification of the external notification buzzer 23 changes from "not give sound notification" to "give sound notification." Thereby, workers can intuitively recognize that they need to immediately move away from the hydraulic excavator 1.

In this manner, where a worker whose interpersonal communication level is equal to or higher than the reference level "2" (i.e. a worker who has made an approval request for entry into the movable range S0, and who is approved to enter the movable range S0) has entered the work range S1, the mode of notification changes, thus it is possible to appropriately prompt the worker to evacuate from the inside of the work range S1 to the outside of the work range S1.

(4) The controller 100 determines whether or not the work range S1 of the hydraulic excavator 1 has been set, and decides a mode of notification by the notification device on the basis of a result of the determination. In the present embodiment, where the work range S1 has not been set, the red LED of the external notification light 22 is flashed even when a worker is not present inside the movable range S0. That is, different modes of notification are used between when the work range S1 has been set and when the work range S1 has not been set. Thereby, workers can know that, in the current state, there is a possibility that work is performed over the entire area of the movable range S0. That is, the workers can judge that approval cannot be given even if they make approval requests. Accordingly, this configuration can eliminate wasteful labor of approval request operation by the workers around the hydraulic excavator 1. As a result, it is possible to attempt to enhance the work efficiency of the workers.

(5) The controller 100 executes restriction control of restricting operation of the work implement 10 when the worker position sensor has sensed the presence, in the movable range S0, of a worker for whom the interpersonal communication level equal to or lower than the reference level "2" has been set, as compared to when the worker is not present inside the movable range S0. Where the unapproved worker is present inside the movable range S0, operation of the work implement 10 is restricted, thus the operator can immediately know that the unapproved worker has entered the movable range S0. In addition, the work efficiency lowers if operation of the work implement 10 remains restricted. Accordingly, an advantage of prompting the operator to take action to ask the worker to evacuate can be expected. That is, according to the present embodiment, it is possible to attempt to correct the situation at a work site.

(6) The controller 100 executes restriction control of restricting operation of the work implement 10 irrespective of the interpersonal communication level when the worker position sensor has sensed the worker in the work range S1, as compared to when the worker is not present inside the work range S1. Where the worker is present inside the work range S1, operation of the work implement 10 is restricted, thus the operator can immediately know that the worker has entered the work range S1. In addition, the work efficiency lowers if operation of the work implement 10 remains restricted. Accordingly, an advantage of prompting the operator to take action to ask the worker to evacuate can be expected. That is, according to the present embodiment, it is possible to attempt to correct the situation at a work site.

(7) The controller 100 gives notifications in different modes of notification between when the gate lock lever **60*a* is operated to be at the lock position (raised position), and operation of the hydraulic excavator 1 is disabled, and when the gate lock lever 60*a* is operated to be at the unlock position (lowered position), and operation of the hydraulic excavator 1 is enabled. In the present embodiment, the mode of notification in a state in which operation of the hydraulic excavator 1 is disabled is a mode of notification of turning on an LED of the external notification light 22, and the mode of notification in a state in which operation of the hydraulic excavator 1 is enabled is a mode of notification of flashing an LED of the external notification light 22. Thereby, workers can easily judge from the outside of the hydraulic excavator 1 whether or not operation of the hydraulic excavator 1** is enabled.

Modification examples like the ones mentioned below are also covered by the scope of the present invention, and it is also possible to combine the configuration depicted in a modification example and the configuration explained in the embodiment mentioned above, combine the configuration explained in different modification examples below, and so on.

Modification Example 1

Whereas the position of a worker as measured from the excavator is computed on the basis of positional information about a mobile terminal 5 measured by the GNSS module 53 of the mobile terminal 5, and positional information about the hydraulic excavator 1 in the example explained in the embodiment described above, the present invention is not limited to this. For example, the position of a worker may be sensed on the basis of an image captured by a camera mounted on the hydraulic excavator 1, a camera installed around the hydraulic excavator 1 or the like. In addition, the position of a worker may be sensed by using a 3D-LiDAR. It should be noted that, in this case, the sensed worker and an ID for identifying the worker need to be associated with each other. Because of this, the controller 100 performs an identification process using a worker facial authentication system, an RFID system, or the like. In this manner, by adopting configuration in which the position of a worker is computed without using a GNSS, not a highly functional device like a tablet, but a simple device like an RFID tag provided with a switch for inputting an indication whether to or not to make an approval request can be adopted as a mobile terminal.

Modification Example 2

Whereas stop control is executed when the hydraulic excavator 1 is in an operative state, and additionally a worker is present inside the work range S1 in the example explained in the embodiment described above, the present invention is not limited to this. Deceleration control may be executed instead of stop control.

Modification Example 3

Whereas, as depicted in FIG. 5, an area obtained by synthesizing the fan-shaped area A1 defined by the left swing limit angle θL, the right swing limit angle θR, and the work radius Rw, and the circular area A2 with the radius Rs centered on the swing center axis O is set as the work range S1 in the example explained in the embodiment described above, the present invention is not limited to this. For example, by touching a plurality of locations on the touch panel monitor 18, a polygonal work range having vertexes at the touched positions may be set.

Modification Example 4

Whereas if the work range S1 is set by operation on the touch panel monitor 18, the work mode is set to the entry-allowing mode, and if the work range S1 is not set, the work mode is set to the entry-prohibiting mode in the example explained in the embodiment described above, the present invention is not limited to this.

Modification Example 4-1

A mode switching operation member that can perform operation to switch the mode to the entry-prohibiting mode and to the work mode may be provided in the operation room 7.

Modification Example 4-2

Where a malfunction or an abnormality of the hydraulic excavator 1 is sensed, the entry-prohibiting mode may be selected automatically. For example, where it is not possible to accurately determine the position of the hydraulic excavator 1 for a reason such as the worsened reception of the GNSS receiving device 50, there is a fear that it is not possible to appropriately determine whether or not a worker is present inside the movable range S0. Accordingly, where such an abnormality is sensed, the controller 100 automatically selects the entry-prohibiting mode. Thereby, where an abnormality is sensed, an appropriate notification can be given to workers, and it is possible to prevent the workers from entering the movable range S0 of the hydraulic excavator 1.

Modification Example 5

Whereas the hydraulic excavator 1 including the electric-lever operation device 34 is explained as an example in the embodiment described above, the present invention may be applied to a hydraulic excavator including a hydraulic-pilot-lever operation device. In this case, by adopting configuration in which command pilot pressures generated by the operation device can be reduced by using a solenoid proportional valve, it is possible to restrict operation of actuators and driven members.

Modification Example 6

Whereas hydraulic equipment such as hydraulic motors (the travel motors 2*a* and swing motor 3*a*), and hydraulic cylinders (the boom cylinder 11*a*, the arm cylinder 12*a*, and the bucket cylinder 13*a*) are included as actuators in the example explained in the embodiment described above, the present invention may be applied to a work machine including, as actuators, electrically driven equipment such as electrically driven motors or electrically driven cylinders.

Modification Example 7

Whereas the work machine is a crawler-type hydraulic excavator in the example explained in the embodiment described above, the present invention is not limited to this. The present invention can be applied to various work machines such as wheel-type hydraulic excavators or crawler cranes.

Modification Example 8

Whereas the touch panel monitor 18 functions as an informing device that informs the operator of predetermined information, and as an input device for inputting predetermined information in the example explained in the embodiment described above, the present invention is not limited to this. An informing device and an input device may be provided separately. In addition, as an informing device, a sound output device that informs the operator of predetermined information by sound may be included.

Whereas an embodiment of the present invention has been explained thus far, the embodiment described above is depicted merely as some of application examples of the present invention, and it is not aimed to limit the technical scope of the present invention to the specific configuration of the embodiment described above.

DESCRIPTION OF REFERENCE CHARACTERS

1: Hydraulic excavator (work machine)
4: Machine body

5: Mobile terminal
7: Operation room
10: Work implement
18: Touch panel monitor (informing device, work range setting device, input device)
20: Communication device (worker position sensor)
22: External notification light (notification device)
23: External notification buzzer (notification device)
34: Operation device
50: GNSS receiving device (worker position sensor)
100: Controller (controller, work position sensor)
S0: Movable range
S1: Work range

The invention claimed is:

1. A work machine comprising:
a machine body;
a work implement attached to the machine body;
an operation device that is provided in an operation room, and gives an instruction about operation of the work implement according to operation by an operator;
an informing device that informs the operator;
an input device for inputting predetermined information;
a notification device that gives a notification to a worker around the work machine;
a controller that controls the informing device and the notification device; and
a communication device that communicates with a mobile terminal carried by the worker, wherein
the controller is configured to
determine whether or not the communication device has received an approval request for requesting approval of entry into a movable range of the work machine, the approval request being transmitted from the mobile terminal when the worker operates the mobile terminal,
inform, by using the informing device, that the approval request has been received, when it is determined that the approval request has been received,
determine whether or not approval operation of approving entry into the movable range of the work machine has been performed on the input device,
set an interpersonal communication level representing a degree of interpersonal communication between the operator and the worker, depending on whether or not the approval request has been received and whether or not the approval operation has been performed,
decide a mode of notification by the notification device in accordance with the interpersonal communication level, and
give a notification in the decided mode of notification by using the notification device.

2. The work machine according to claim 1, wherein
the work machine includes a worker position sensor that senses a position of the worker around the work machine, and
the controller is configured to
change the mode of notification when the worker position sensor has sensed that a worker for whom the interpersonal communication level equal to or lower than a reference level is set has moved from an outside of the movable range of the work machine to an inside of the movable range.

3. The work machine according to claim 1, wherein
the work machine includes
a worker position sensor that senses a position of the worker around the work machine, and
a work range setting device that sets a work range of the work machine, and
the controller is configured to
change the mode of notification when the worker position sensor has sensed that a worker for whom the interpersonal communication level equal to or higher than a reference level is set has moved from an outside of the work range to an inside of the work range.

4. The work machine according to claim 1, wherein
the work machine includes a work range setting device that sets a work range of the work machine, and
the controller is configured to
determine whether or not the work range of the work machine has been set, and decide the mode of notification on a basis of a result of the determination.

5. The work machine according to claim 2, wherein
the controller is configured to
restrict operation of the work implement when the worker position sensor has sensed presence, in the movable range, of a worker for whom the interpersonal communication level equal to or lower than the reference level is set.

6. The work machine according to claim 5, wherein
the work machine includes a work range setting device that sets a work range of the work machine, and
the controller is configured to
restrict operation of the work implement irrespective of the interpersonal communication level when the worker position sensor has sensed the worker in the work range.

* * * * *